US009141058B2

(12) United States Patent
Saito et al.

(10) Patent No.: US 9,141,058 B2
(45) Date of Patent: Sep. 22, 2015

(54) IMAGE FORMING APPARATUS WITH CHANGING PHOTOSENSITIVE MEMBER SPEED

(75) Inventors: Yoshiro Saito, Boise, ID (US); Yasutaka Yagi, Mishima (JP); Hiroyuki Seki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/540,026

(22) Filed: Jul. 2, 2012

(65) Prior Publication Data

US 2013/0011152 A1 Jan. 10, 2013

(30) Foreign Application Priority Data

Jul. 7, 2011 (JP) ..... 2011-150905

(51) Int. Cl.
*G03G 15/00* (2006.01)
*G03G 15/01* (2006.01)

(52) U.S. Cl.
CPC ..... *G03G 15/5008* (2013.01); *G03G 15/0189* (2013.01); *G03G 2215/0132* (2013.01)

(58) Field of Classification Search
USPC ..... 399/45
See application file for complete search history.

(56) References Cited

U.S. PATENT DOCUMENTS

| | | | | |
|---|---|---|---|---|
| 2005/0008415 | A1* | 1/2005 | Tanaka et al. | 399/358 |
| 2012/0251150 | A1* | 10/2012 | Nara et al. | 399/66 |
| 2013/0343775 | A1* | 12/2013 | Yamaguchi et al. | 399/49 |

FOREIGN PATENT DOCUMENTS

| | | | | |
|---|---|---|---|---|
| CN | 1232975 | A | | 10/1999 |
| CN | 1637636 | A | | 7/2005 |
| JP | 61240275 | A | * | 10/1986 |
| JP | H11-327403 | A | | 11/1999 |
| JP | 2001-183915 | A | | 7/2001 |
| JP | 2002-091095 | A | | 3/2002 |
| JP | 2002-244487 | A | | 8/2002 |
| JP | 2003021939 | A | * | 1/2003 |
| JP | 2003-207981 | A | | 7/2003 |
| JP | 2005-284186 | A | | 10/2005 |
| JP | 2006-171360 | A | | 6/2006 |
| JP | 2007-017691 | A | | 1/2007 |
| JP | 2007108361 | A | * | 4/2007 |
| JP | 2009-75150 | A | | 3/2009 |
| JP | 2010-066530 | A | | 3/2010 |

OTHER PUBLICATIONS translation of JP2007-108361A, to Kitamura, Apr. 26, 2007.*

* cited by examiner

*Primary Examiner* — Quana M Grainger

(74) *Attorney, Agent, or Firm* — Canon U.S.A., Inc. IP Division

(57) ABSTRACT

There is provided an image forming apparatus in which an image forming speed is changed in a state where toner is provided between a photosensitive drum and an intermediate transfer member. Therefore, even if a speed difference between the photosensitive drum and the intermediate transfer member is generated, a drive torque can be suppressed, and deterioration caused by abrasion of the photosensitive drum and the intermediate transfer member can be reduced.

19 Claims, 21 Drawing Sheets

CAPTURED IMAGE OF RECORDING MATERIAL

SHADING CORRECTION IMAGE

ONE EXAMPLE OF DISCRIMINATION REFERENCE TABLE OF RECORDING MATERIALS

IMAGE FORMING APPARATUS WITH CHANGING PHOTOSENSITIVE MEMBER SPEED

BACKGROUND OF THE INVENTION

1. Field of the Invention

The present invention relates to an image forming apparatus such as a copy machine, a printer, or a facsimile machine which employs an electrophotographic method or an electrographic recording method.

2. Description of the Related Art

In recent years, image forming apparatuses are arranged, during image formation, to change image forming speed according to, for example, the type of recording material or the image to be formed. A high-quality image can be formed by setting the speed to a suitable image forming speed. However, the generation of a speed difference between a photosensitive drum and an intermediate transfer member, when switching the image forming speed, leads to a deterioration in the formed image caused by abrasion of the members.

Japanese Patent Application Laid-Open No. 2003-207981, for example, discusses a technique in which the speed of a photosensitive drum and the speed of an intermediate transfer member are detected using an encoder to reduce the speed difference between the photosensitive drum and the intermediate transfer member such that it falls within a predetermined range. Thereby, image deterioration caused by abrasion of the photosensitive drum and the intermediate transfer member can be reduced.

However, even when control is performed as discussed in Japanese Patent Application Laid-Open No. 2003-207981, it is difficult to completely eliminate a circumferential speed difference between the photosensitive drum and the intermediate transfer member, which may cause a slight deterioration due to the abrasion of the photosensitive drum or the intermediate transfer member.

In view of the above, a control method can be also considered, which stops a photosensitive drum and an intermediate transfer member and then drives the photosensitive drum and the intermediate transfer member again at a new desired speed, to suppress the generation of a circumferential speed difference when changing an image forming speed. However, there is an issue that when such control is performed, it takes increased time to change the image forming speed.

SUMMARY OF THE INVENTION

The present invention is directed to an image forming apparatus capable of reducing deterioration caused by abrasion of a photosensitive drum and an intermediate transfer member when changing an image forming speed, and of suppressing the time required to change the image forming speed.

According to an aspect of the present invention, an image forming apparatus includes an image bearing member on which a latent image is formed, a development unit configured to develop the latent image formed on the image bearing member, an intermediate transfer member contacting the image bearing member, and on which a toner image formed on the image bearing member is transferred, and a control unit configured to control speeds, wherein the control unit changes the speeds of the image bearing member and the intermediate transfer member in a state where toner on the image bearing member, which is supplied by driving the development unit before changing the speeds of the image bearing member and the intermediate transfer member, is provided in a nip portion at which the image bearing member and the intermediate transfer member are brought into contact with each other.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The exemplary embodiments described below shall not to be construed as limiting the scope of the present invention. Further, all the combinations of features described in the exemplary embodiments are not always necessary in solving the problems of the present invention. Each of the embodiments of the present invention described below can be implemented solely or as a combination of a plurality of the embodiments or features thereof where necessary or where the combination of elements or features from individual embodiments in a single embodiment is beneficial.

Figure 1:
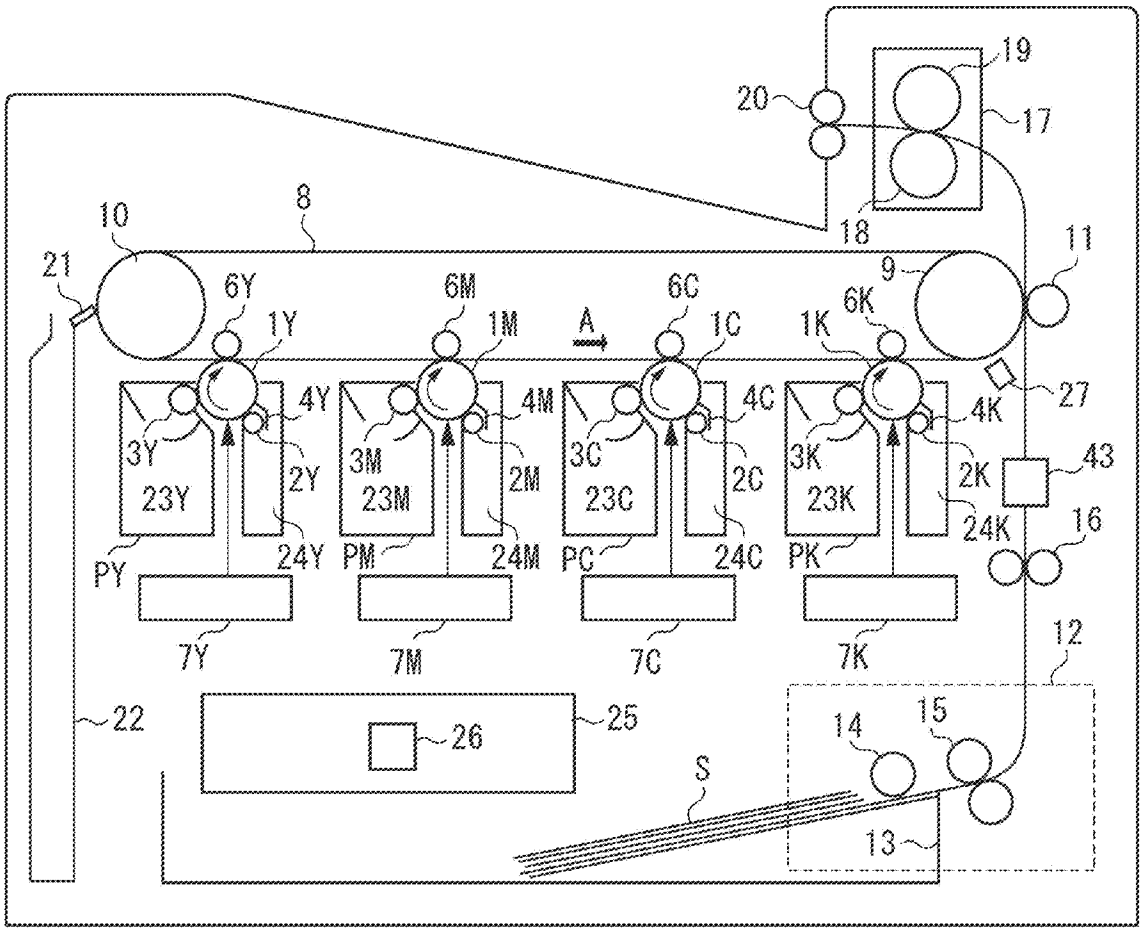
FIG. 1 is a schematic constitution diagram of an image forming apparatus.

FIG. 1 is a schematic constitution diagram of an image forming apparatus. Herein, a four-drum full-color image forming apparatus using an intermediate transfer belt among image forming apparatuses employing an electrophotographic method is illustrated as an example of the image forming apparatus.

The full-color image forming apparatus (hereinafter, also referred to as an apparatus main body) illustrated in FIG. 1 includes attachable/detachable process cartridges P (PY, PM, PC, and PK). These four process cartridges PY, PM, PC, and PK have a similar structure. Colors of toners stored in the process cartridges are different from each other. That is, an image is formed by toners of yellow (Y), magenta (M), cyan (C), and black (K).

The process cartridges PY, PM, PC, and PK respectively include toner containers 23Y, 23M, 23C, and 23K. Further, the process cartridges PY, PM, PC, and PK respectively include photosensitive drums 1Y, 1M, 1C, and 1K, which are image bearing members. Further, the process cartridges PY, PM, PC, and PK respectively include charging rollers 2Y, 2M, 2C, and 2K; development rollers 3Y, 3M, 3C, and 3K; drum cleaning blades 4Y, 4M, 4C, and 4K; and waste toner containers 24Y, 24M, 24C, and 24K.

Laser units 7Y, 7M, 7C, and 7K are respectively disposed below the process cartridges PY, PM, PC, and PK, and perform exposure of the photosensitive drums 1Y, 1M, 1C, and 1K based on an image signal.

The photosensitive drums 1Y, 1M, 1C, and 1K are charged to a predetermined negative potential by the charging rollers 2Y, 2M, 2C, and 2K, respectively. Then, electrostatic latent images are formed on the photosensitive drums 1Y, 1M, 1C, and 1K by the laser units 7Y, 7M, 7C, and 7K, respectively. Each of the electrostatic latent images is subjected to reversal development by each of the development rollers 3Y, 3M, 3C, and 3K. Thus, toner of negative polarity is attached to each of the electrostatic latent images and a toner image of each of Y, M, C, and K colors is formed on each of the photosensitive drums.

An intermediate transfer belt unit includes an intermediate transfer belt 8, a drive roller 9, and a driven roller 10. Primary transfer rollers 6Y, 6M, 6C, and 6K are disposed inside the intermediate transfer belt 8, respectively facing the photosensitive drums 1Y, 1M, 1C, and 1K, to apply transfer bias thereto by a bias application unit (not illustrated).

A color misregistration detection sensor 27, which is an optical sensor, detects a toner pattern for calibration formed on the intermediate transfer belt. The color misregistration detection sensor 27 is placed in the vicinity of the drive roller 9.

Each of the toner images formed on the photosensitive drums 1Y, 1M, 1C, and 1K, that is, the image bearing members is transferred by rotating each of the photosensitive drums in the direction of the arrow, rotating the intermediate transfer belt 8 in the direction of the arrow A, and applying bias of positive polarity to the primary transfer rollers 6Y, 6M, 6C, and 6K.

Each of the toner images formed on the photosensitive drums 1Y, 1M, 1C, and 1K is sequentially primary transferred onto the intermediate transfer belt 8 starting from the toner image on the photosensitive drum 1Y. Then, the toner images of four colors are conveyed in an overlapped state to a secondary transfer roller 11.

A feeding and conveyance device 12 includes a feed roller 14 which feeds a recording material S from a feed cassette 13 containing the recording material S, and a conveyance roller pair 15 which conveys the fed recording material S. The recording material S conveyed from the feeding and conveyance device 12 is conveyed to the secondary transfer roller 11 by a registration roller pair 16.

A recording material discrimination device 43 irradiates the recording material S with light, to discriminate the type of the recording material S held by the registration roller pair 16. The recording material discrimination device 43 discriminates the recording material S based on the result obtained by capturing the recording material S.

The recording material discrimination device 43 will be described in detail below. The imaging type sensor has been described as an example for discriminating the recording material S herein. However, the recording material discrimination device 43 is not limited thereto. A light amount detecting type sensor may be used, or an ultrasonic type sensor may be used.

The bias of positive polarity is applied to the secondary transfer roller 11, to transfer the toner image to the recording material S from the intermediate transfer belt 8. Thereby, the toner image formed on the intermediate transfer belt 8 is secondary transferred onto the recording material S being conveyed.

The recording material S with the transferred toner image is conveyed to a fixing device 17. Then, the fixing device 17 fixes the toner image onto the surface of the recording material S by applying heat and pressure with a fixing film 18 and a pressure roller 19. Subsequently, the recording material S with the fixed toner image is discharged by a discharge roller pair 20.

Toner remaining on the surfaces of the photosensitive drums 1Y, 1M, 1C, and 1K after the toner image is transferred to the recording material S is removed by the cleaning blades 4Y, 4M, 4C, and 4K. Toner remaining on the intermediate transfer belt 8 after secondary transfer to the recording material S is removed by the cleaning blade 21, and the removed toner is collected into a waste toner container 22.

A control substrate 25 mounts an electric circuit for controlling the apparatus main body as well as a central processing unit (CPU) 26 as a control unit. The CPU 26 totally controls operations of the apparatus main body, including control of a driving source (not illustrated) related to conveyance of the recording material S, control of a driving source (not illustrated) related to the process cartridges PY, PM, PC, and PK, control related to image formation, and control related to failure detection.

A mechanism for switching between abutment and separation of the development roller 3 and the photosensitive drum 1 will be described below with reference to FIG. 2. A stepping motor is used as an abutment/separation motor 31, which is a driving source for switching between abutment and separation of the development roller 3 and the photosensitive drum 1. The abutment/separation motor 31 is connected with a drive change shaft 32 via a pinion gear.

In the present exemplary embodiment, although a stepping motor is employed as an example of the abutment/separation motor 31, the type of the abutment/separation motor is not limited to the stepping motor. A DC brush motor or a DC brushless motor may also be used as a drive source.

Worm gears 33 used for driving cam gears 34 of the four colors are provided on the drive change shaft 32. When the drive change shaft 32 rotates, phases of cams 35 of the cam gears 34 change. The cams 35 press or release pressing to the side faces of the process cartridges P, and thereby one abutment/separation motor 31 can switch between abutment and separation of the photosensitive drum 1 and the development roller 3.

Figure 2A:
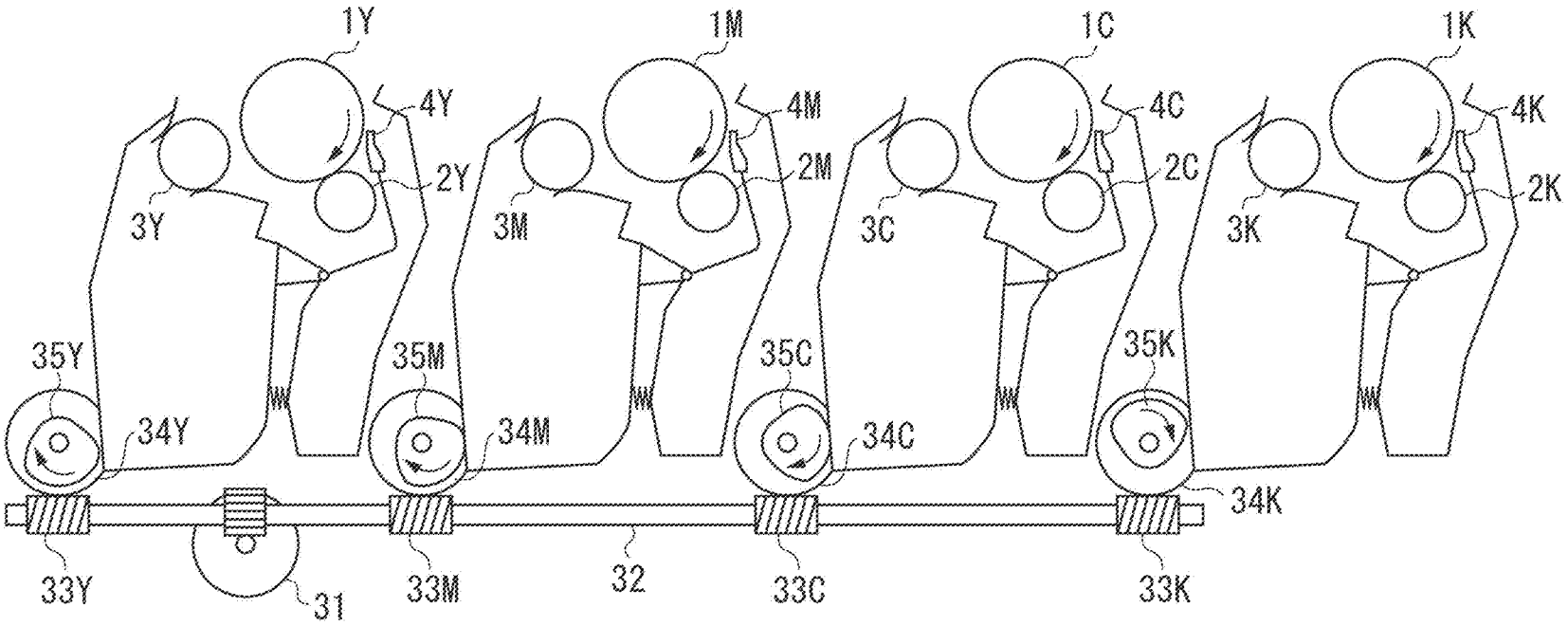
FIGS. 2A to 2C illustrate a mechanism configured to switch between abutment and separation between a development roller 3 and a photosensitive drum 1.

FIG. 2A illustrates a standby state (entire separation state) where the cams 35 (35Y, 35M, 35C, and 35K) press the side faces of the process cartridges P (PY, PM, PC, and PK) with the maximum radius of the cams, so that all the development rollers 3 (3Y, 3M, 3C, and 3K) are separated from all the photosensitive drums 1 (1Y, 1M, 1C, and 1K).

Figure 2B:
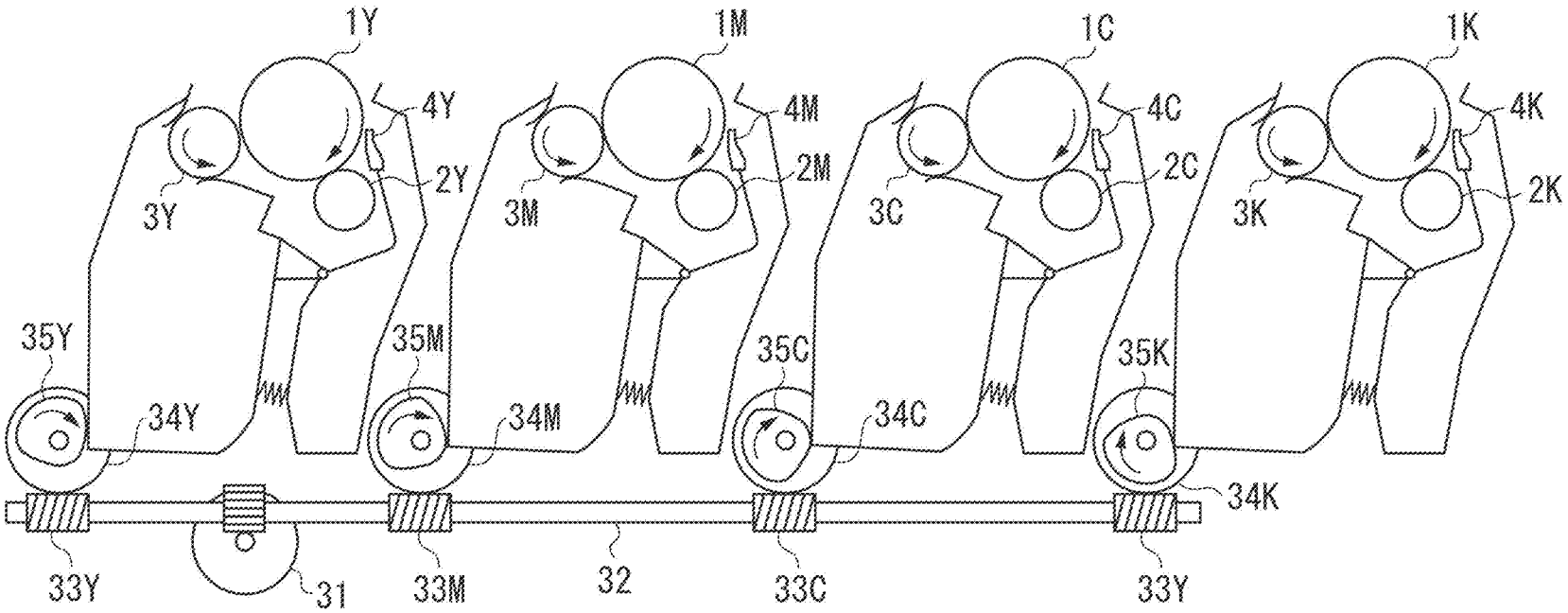

FIG. 2B illustrates a full-color abutment state where the pressing by all the cams 35 (35Y, 35M, 35C, and 35K) onto the side faces of the process cartridges P (PY, PM, PC, and PK) is released, so that all the development rollers 3 (3Y, 3M, 3C, and 3K) abut on all the photosensitive drums 1 (1Y, 1M, 1C, and 1K).

Figure 2C:
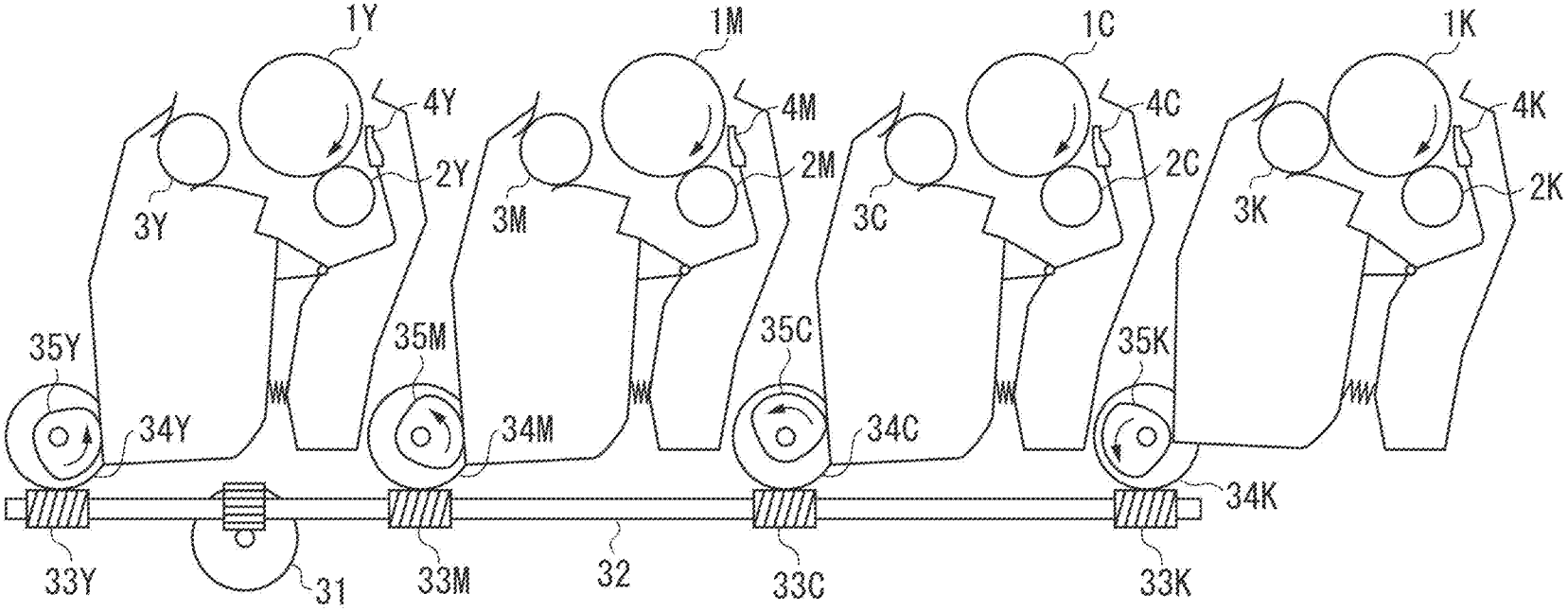

In FIG. 2C, the cams 35 (35Y, 35M, and 35C) of the yellow (Y), magenta (M), and cyan (C) colors press the side faces of the corresponding process cartridges P (PY, PM, and PC) with the maximum radius.

FIG. 2C illustrates a mono-color abutment state where the pressing of only the cam 35K of the black (K) color is released from the side face of the process cartridge PK, and thus, only the development roller 3K of the black color abuts on the photosensitive drum 1K.

Next, a state change from the standby state illustrated in FIG. 2A to the full-color abutment state illustrated in FIG. 2B, and a state change from the standby state illustrated in FIG. 2A to the mono-color abutment state illustrated in FIG. 2C will be described.

When the abutment/separation motor 31 is forwardly rotated in the standby state illustrated in FIG. 2A, each of the cams 35Y, 35M, 35C, and 35K rotates in the clockwise direction. With reference to the cam 35Y, each phase of the cams 35M, 35C, and 35K has a phase shift in the counterclockwise direction in the order of the cam 35M, the cam 35C, and the cam 35K.

Due to this phase shift, when each of the cams 35Y, 35M, 35C, and 35K rotates in the clockwise direction, the cam 35Y releases pressing to the side face of the process cartridge PY first. Subsequently, according to the phase shift, the cams 35M, 35C, and 35K release pressing to the side face of the corresponding process cartridge in the order of the cam 35M, the cam 35C, and the cam 35K. Thus, when the abutment/separation motor 31 is forwardly rotated from the standby state in FIG. 2A, the development rollers 3 abut on the photosensitive drums 1, respectively, in the order of Y, M, C, and K. Then the state of the mechanism is changed to the full-color abutment state illustrated in FIG. 2B.

When the state changes from the full-color abutment state to the standby state, the abutment/separation motor 31 is forwardly rotated. Then, each of the development rollers 3 is separated from each of the photosensitive drums 1 in the order of Y, M, C, and K.

If the abutment/separation motor 31 is reversely rotated in the standby state illustrated in FIG. 2A, each of the cams 35Y, 35M, 35C, and 35K rotates in the counterclockwise direction. If the abutment/separation motor 31 is reversely rotated, the cam 35K releases the pressing from the side face of the process cartridge PK first. When the drive of the abutment/separation motor 31 is stopped in this state, the result is the mono-color abutment state illustrated in FIG. 2C.

When the state changes from the mono-color abutment state to the standby state, the abutment/separation motor 31 is forwardly rotated, and thereby the cam 35K presses the side face of the process cartridge PK again, thus resulting in the standby state.

Thus, the image forming apparatus can control abutment and separation states of the development roller 3 and the photosensitive drum 1 by controlling the rotational direction and the rotation amount of the abutment/separation motor 31 as the three states in FIGS. 2A to 2C.

Figure 3:
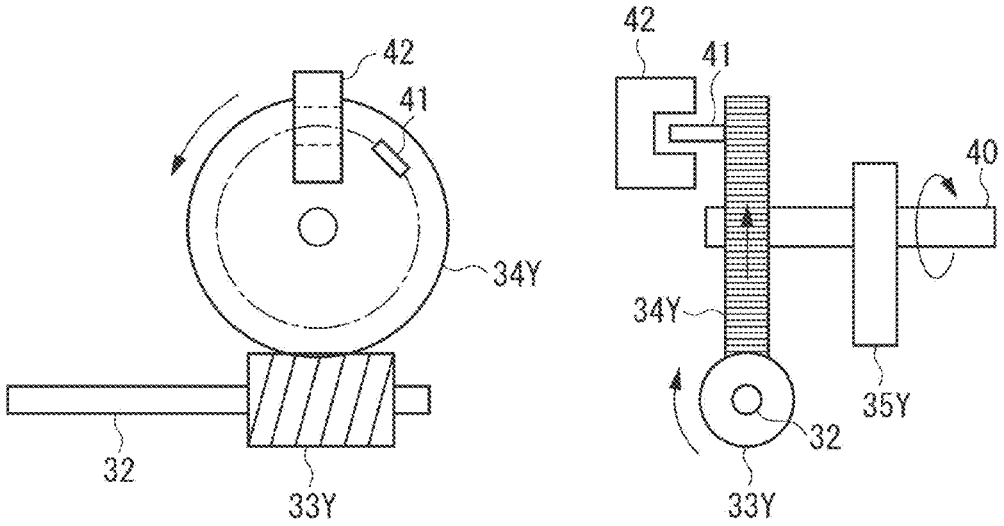
FIG. 3 illustrates a mechanism configured to detect a phase of a cam.

The above-described control can be realized since a rib 41 is partially provided on the cam gear 34Y of Y (yellow) as illustrated in FIG. 3. When the cam gear 34Y rotates, the rib 41 also rotates and shields light in the photo interrupter 42. Accordingly, the phase of the cam 35Y rotating with the cam gear 34 can be detected based on a signal output from the photo interrupter 42.

The phase of the cam 35 (standby state, full-color abutment state, and mono-color abutment state) is controlled by setting the position where the light in the photo interrupter 42 is shielded as the reference position, and managing the number of driving steps of the abutment/separation motor 31 from the position.

Figure 4:
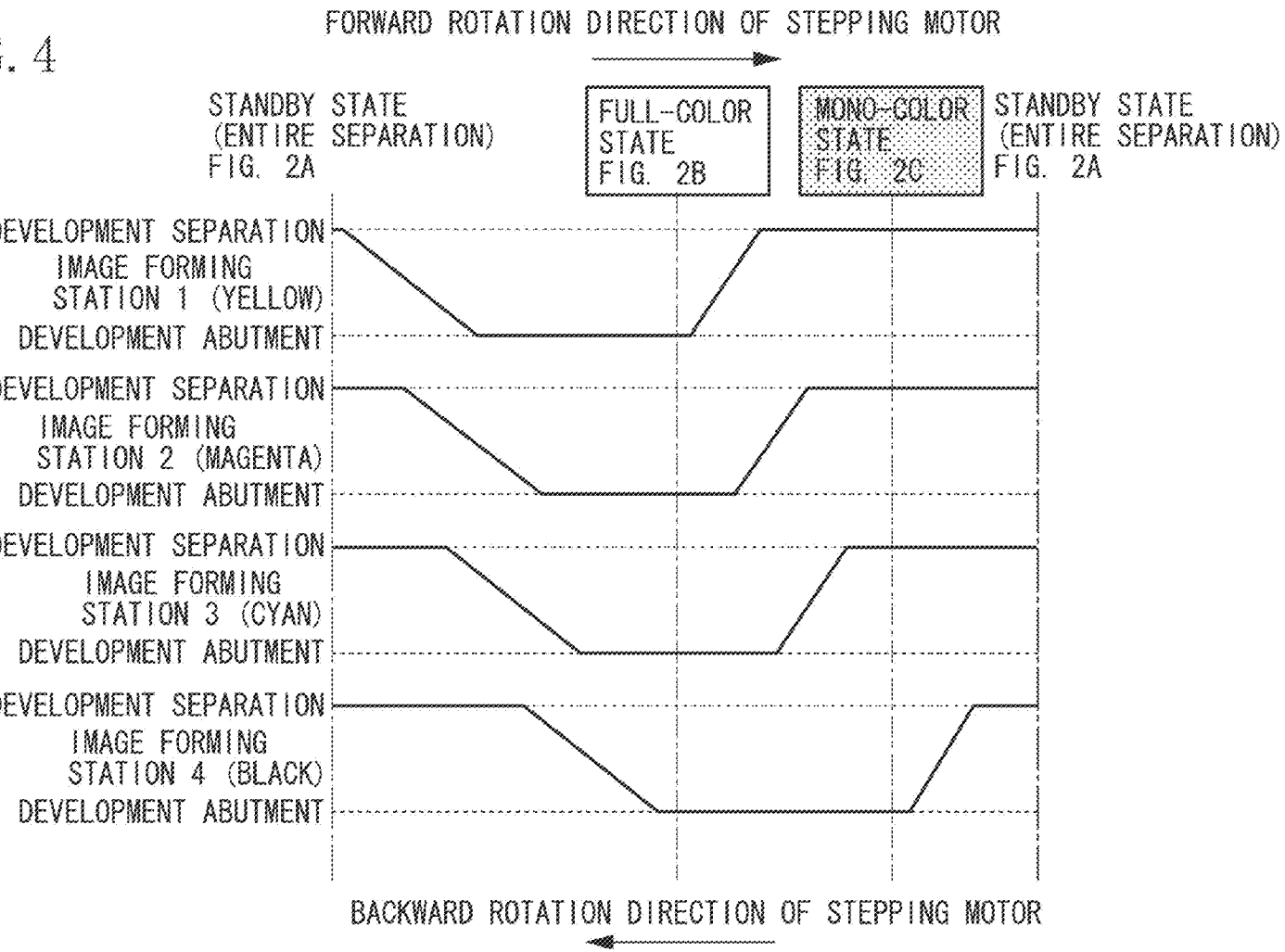
FIG. 4 is a cam diagram illustrating an abutment state between the photosensitive drum and the development roller.

FIG. 4 is a cam diagram illustrating phase changes of the cam gears 34 and a relation between the three controllable states. As illustrated in the cam diagram of FIG. 4, abutment/separation state changeover is possible by controlling shifting of phases of the cams 35Y, 35M, 35C, and 35K.

The cam diagram illustrated in FIG. 4 denotes design center values. Variation may be generated in also the cam diagram by dimensional variations or the like of the components illustrated in FIGS. 2A, 2B, and 2C.

When performing an ordinary printing operation, abutment and separation of the development roller 3 are changed from the standby state to the full-color abutment state or from the standby state to the mono-color abutment state according to a timing to start image formation.

Firstly, abutment/separation state changeover control when performing full-color printing will be described below. Hereinafter, a constitution including the development roller 3 and the photosensitive drum 1 is defined as an image forming station. An image forming station which performs image formation with yellow toner is defined as an image forming station 1 (also referred to as a 1st image forming station).

Similarly, image forming stations which perform image formation with magenta, cyan, and black toners are defined as an image forming station 2 (2st), an image forming station 3 (3st), and an image forming station 4 (4st), respectively.

When performing full-color printing, the abutment/separation motor 31 is forwardly rotated by a predetermined number of steps according to a timing to start image formation. When the abutment/separation motor 31 starts being forwardly rotated, each image forming station undergoes an indefinite duration during which the respective development roller 3 and photosensitive drum 1 may or may not abut on each other.

Then, abutment between the development roller 3 and the photosensitive drum 1 is established in order of the image forming station 1 (yellow) image forming station 2 (magenta), image forming station 3 (cyan), and image forming station 4 (black), as illustrated in FIG. 3. Upon completion of abutment at an image forming station, image formation is started at the image forming station.

The number of driving steps of the abutment/separation motor 31 is such that the contact/separation motor 31 stops when all the image forming stations complete abutment. After completion of image formation, the abutment/separation motor 31 is forwardly rotated again by a predetermined number of steps. When the abutment/separation motor 31 starts being forwardly rotated, the development roller 3 and the photosensitive drum 1 undergo an indefinite duration.

Then, separation between the development roller 3 and the photosensitive drum 1 is established in order of the image forming station 1 (yellow), image forming station 2 (magenta), image forming station 3 (cyan), and image forming station 4 (black), to end printing.

The number of driving steps of the abutment/separation motor 31 is such that the abutment/separation motor 31 stops when all the image forming stations complete separation.

Secondly, abutment/separation state changeover control when performing mono-color printing will be described below. When performing mono-color printing, the abutment/separation motor 31 is reversely rotated by a predetermined number of steps according to a timing to start image formation.

When the abutment/separation motor 31 starts being reversely rotated, the development roller 3K and the photosensitive drum 1K of only the image forming station 4 (black) abut on each other as illustrated in FIG. 2 via an indefinite duration, and the image forming station 4 (black) starts image formation. The number of driving steps of the abutment/separation motor 31 is such that the abutment/separation motor 31 stops when only the image forming station 4 (black) completes abutment.

Upon end of image formation, the abutment/separation motor 31 is forwardly rotated by a predetermined number of driving steps. When the abutment/separation motor 31 starts being forwardly rotated, separation between the development roller 3K and the photosensitive drum 1K of the station 4 (black) is established, and completes printing. The number of driving steps of the abutment/separation motor 31 is such that the abutment/separation motor 31 stops when all the stations complete separation.

Figure 5A:
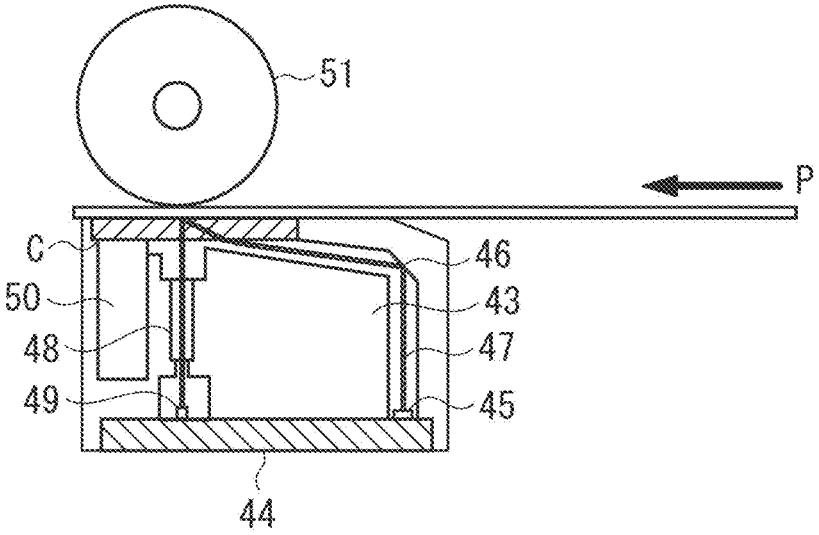
FIGS. 5A and 5B are schematic constitution diagrams of a recording material discrimination device 43.
Figure 5B:
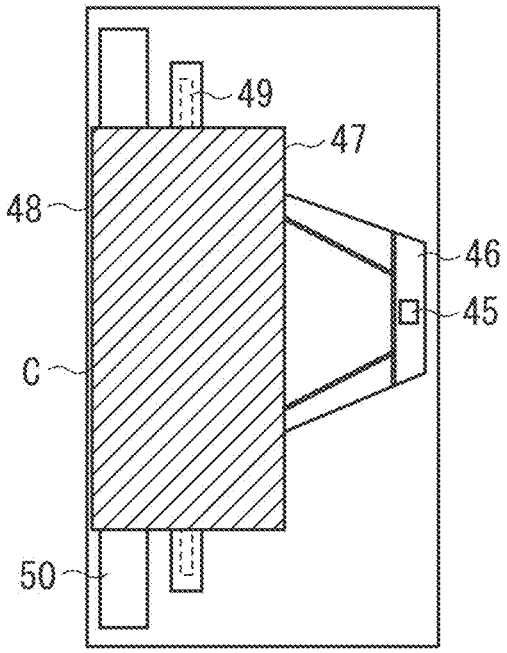

FIGS. 5A and 5B illustrate an example of schematic constitution diagrams of the recording material discrimination device 43. FIG. 5A is a sectional view of the recording material discrimination device viewed from the side of a conveyance direction. FIG. 5B is a plan view of the recording material discrimination device viewed from the upside. An upper lid is illustrated as a partial perspective view, to clarify positions of members such as a light source.

The recording material discrimination device 43 irradiates the inside of a cover member C with light through a light path 47 formed in a folding reflection unit 46 using a chip LED disposed on a substrate 44 as a light source. The recording material discrimination device 43 emits the light to pass through the cover member C toward the recording material S moving in a direction indicated by an arrow in FIG. 5A, and irradiates the recording material S with the light at a shallow angle of about 10 degrees to 15 degrees.

The folding reflection unit 46 may be a plate material made of glass or acrylic or the like with a surface having a reflection film or the like being formed thereon. The folding reflection unit 46 may have a surface adhered to a sheet material with a high reflectance by a double-side tape or the like. Examples of the sheet material include Metalumy (registered trademark) obtained by subjecting a PET base material manufactured by Toray Industries, Inc. to aluminum vapor deposition.

The light irregularly reflected from the surface of the recording material S is condensed by a condensing element (rod lens array) 48, and is captured as the surface image of the recording material S by an imaging element (complementary metal-oxide semiconductor (CMOS) line sensor) 49 disposed on the substrate 44.

The light regularly reflected from the surface of the recording material S enters into a light trapping unit 50, and is self-attenuated in the light trapping unit 50. This prevents stray light to the imaging unit 49.

An opposing member 51 improves the conveying property of the recording material S and suppresses the conveyance flutter of the recording material S. Although the light trapping unit 50 of the present exemplary embodiment is illustrated as a simple groove, the light trapping unit 50 may be realized by the addition and change of a shape having a higher extinction ratio and a material serving as absorption light.

Figure 6:
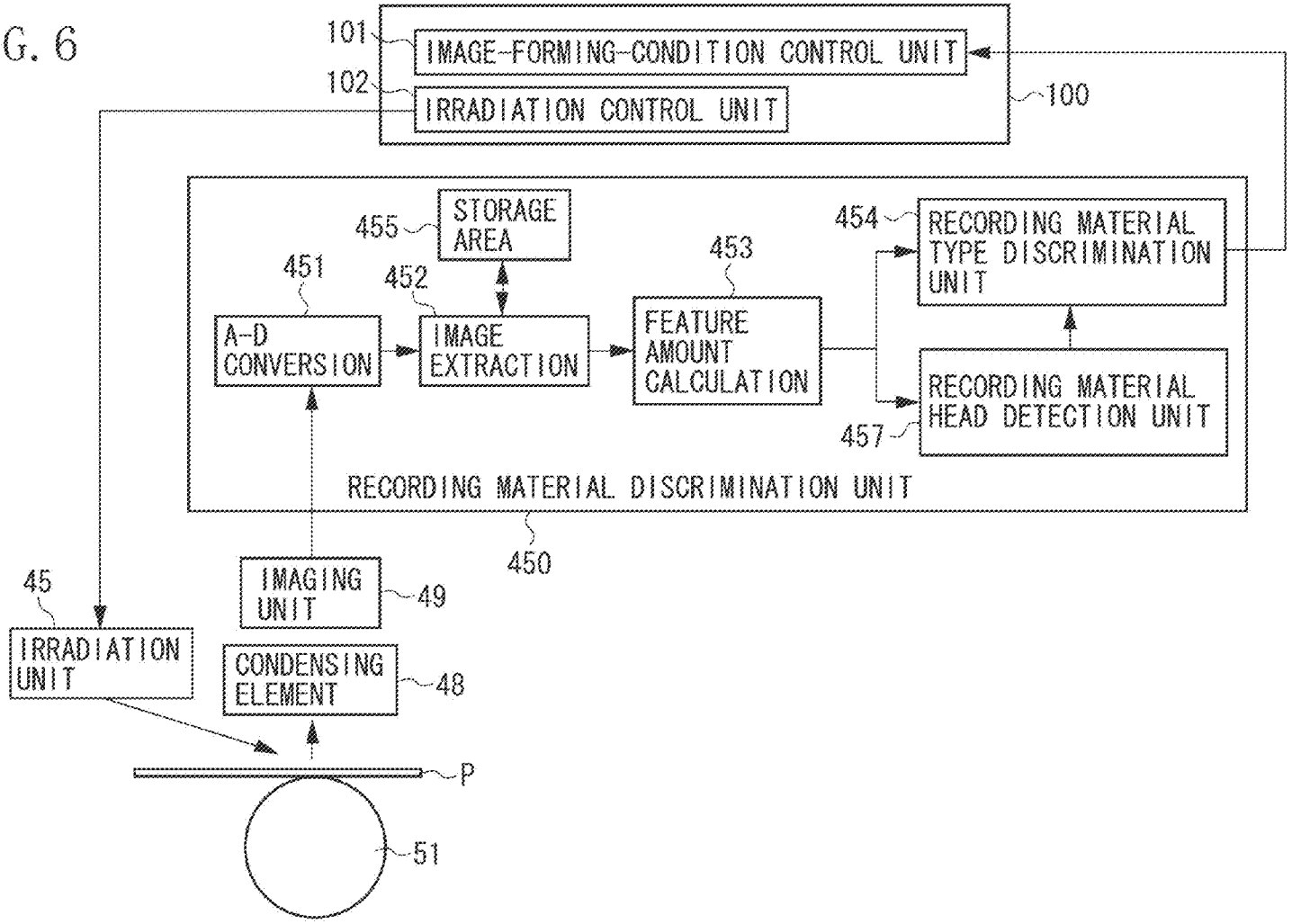
FIG. 6 is a block diagram illustrating operation control of the recording material discrimination device 43.

FIG. 6 illustrates an example of a block diagram illustrating operation control of the recording material discrimination device 43.

An irradiation unit 45 irradiates the surface of the recording material S to be conveyed, with light. The imaging unit 49 captures reflected light from the recording material S as the surface image via the condensing element 48. The surface image of the recording material S captured by the imaging unit 49 is output to a recording material discrimination unit 450.

The recording material discrimination unit 450 subjects the surface image of the received recording material S to AD conversion in an A-D conversion unit 451, to obtain an image on the same line perpendicular to the conveyance direction of the recording material S. In the present exemplary embodiment, the A-D conversion unit 451 outputs values of 0 to 4095 using a 12-bit A-D conversion IC.

An image extraction unit 452 and a storage area unit 455 connect the received surface images of the recording material S in the conveyance direction to acquire a two-dimensional surface image. In the present exemplary embodiment, the conveyance speed of the recording material S is set to 180 mm/second, and the resolution of the imaging unit 49 is set to 600 dpi of one line (about 42 μm per dot). Accordingly, when an area of 10 mm×5 mm of the recording material S is image-captured, an image size is 236 dots×118 dots.

The image-capturing of the imaging unit 49 is performed at 42 μm/(180 mm/second), and the light accumulation of the imaging unit 49 is performed at an about 220 μsec interval. Thereby, imaging areas on the recording material S can be captured without overlapping the imaging areas to be conveyed. When the recording material S is not conveyed, the surface image of the opposing member 51 can also be captured.

The surface image used for discriminating the type of the recording material S is extracted based on information such as an optic axis and an effective image range stored in the storage area unit 455, from the obtained two-dimensional surface image. At this time, the surface image is subjected to shading correction. This is processing required to perform feature amount calculation from the extracted surface image in a feature amount calculation unit 453.

A recording material head detection unit 457 detects the leading end of the recording material S when the recording material S is not conveyed. After the recording material head detection unit 457 detects the leading end of the recording material S, the recording material head detection unit 457 determines that the recording material S is conveyed, and notifies the leading end reach of the recording material S to a recording material type discrimination unit 454 from the recording material head detection unit 457. The recording material type discrimination unit 454 discriminates the type of the recording material S based on the result calculated by the feature amount calculation unit 453.

The recording material type discrimination unit 454 outputs the result of the recording material type discrimination unit 454 to an image-forming-condition control unit 101 of an image forming control unit 100. The image-forming-condition control unit 101 controls an image formation condition based on the discriminated result. The image formation condition is a condition such as a transfer voltage, a conveyance speed of the recording material S, or a temperature of a fixing unit.

For example, when the recording material type discrimination unit 454 discriminates that the recording material is bond paper as a result of discriminating the type of the recording material, fixability is not necessarily good with the image formation condition of plain paper. Therefore, the conveyance speed of the recording material S is lowered to extend a heating time in a fixing nip portion (not-illustrated) in the fixing device 17, thereby improving fixability.

The storage area unit 455 stores a current value controlling the irradiation unit 45 to emit light, a required light amount target value, dark current data when the irradiation unit 45 used to correct nonuniformity of a light amount (described below) is turned off, and light amount distribution data when the irradiation unit 45 is turned on. An irradiation control unit 102 controls the light amount of the irradiation unit 45 based on information when acquiring the light amount distribution data.

An example discriminating the type of the recording material S from the surface image captured by the imaging unit 49 of the recording material discrimination device 43 will be described with reference to FIGS. 7A to 7E and FIG. 8.

In step S100, the CPU 26 starts discrimination control of the recording material. In step S101, the CPU 26 starts conveyance of the recording material S to the recording material discrimination device 43. When the recording material head detection unit 457 detects the leading end of the recording material S, the imaging unit 49 captures the surface image of the recording material S in an imaging range. The imaging unit 49 repeatedly captures the surface image until the surface image reaches an area required for discriminating the recording material S.

Figure 7A:
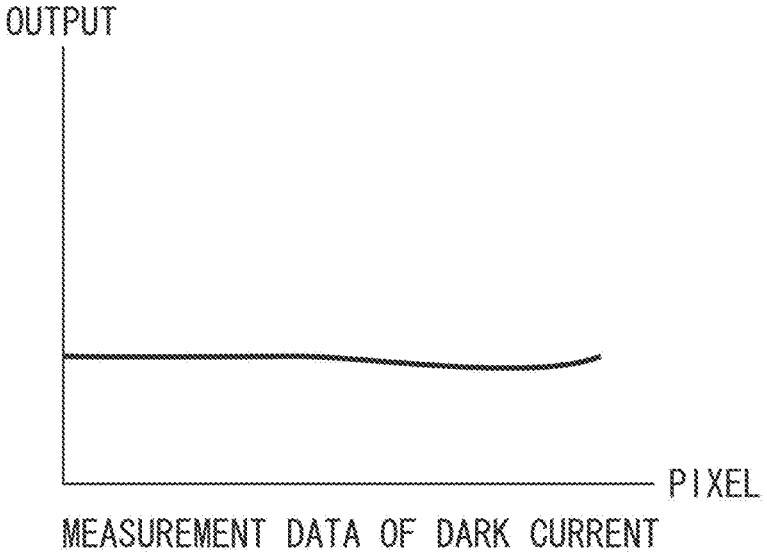
FIG. 7A to 7E illustrate a surface image captured by an imaging unit 49 of the recording material discrimination device 43.

FIG. 7A is a graph illustrating an example of dark current correction data acquired before detecting the head of the recording material S.

Figure 7B:
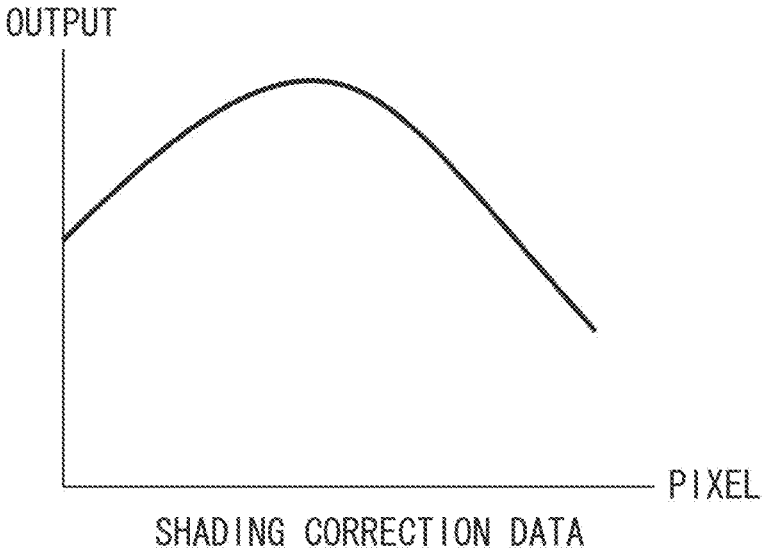

FIG. 7B is a graph illustrating an example of shading correction data acquired before detecting the leading end of the recording material S or stored in a storage unit (not-illustrated). The storage unit holds the shading correction data even if a standard sheet is not conveyed for each printing, and thereby the detection can be omitted.

Figure 7C:
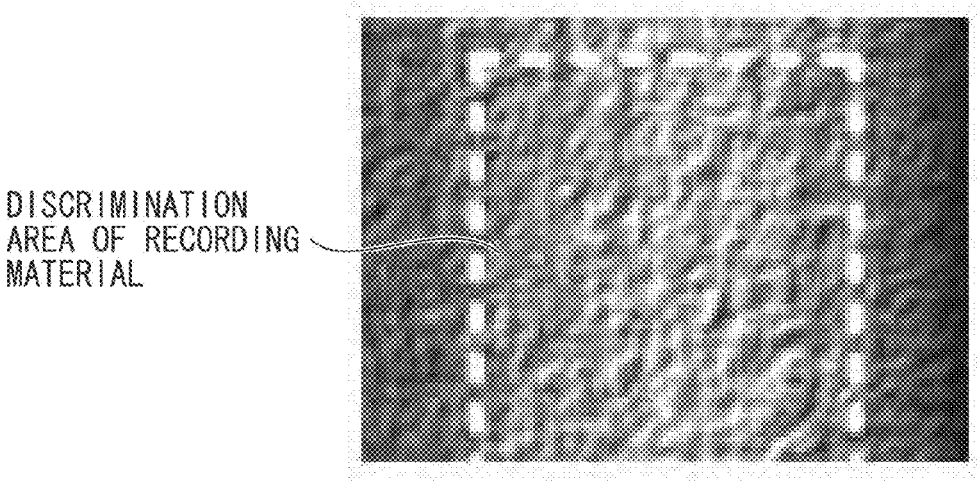

FIG. 7C illustrates an example of the image data of the captured recording material S (trade name: Neenah Bond 60).

In step S102, the CPU 26 confirms the whole light amount of the recording material discrimination area surrounded by a white dotted line of FIG. 7C from the surface image of the recording material S. This processing is performed to confirm the brightness of the recording material S. In the present exemplary embodiment, the whole light amount is used for information for discriminating the recording material as one of the feature amounts of the surface of the recording material.

In step S103, the CPU 26 subjects the captured surface image to the shading correction using the shading correction data, to detect the surface roughness of the recording material S. The CPU 26 subjects the surface image to the shading correction to enable the correction of the light amount nonuniformity of the surface image and the accurate detection of the surface roughness of the recording material S.

Figure 7D:
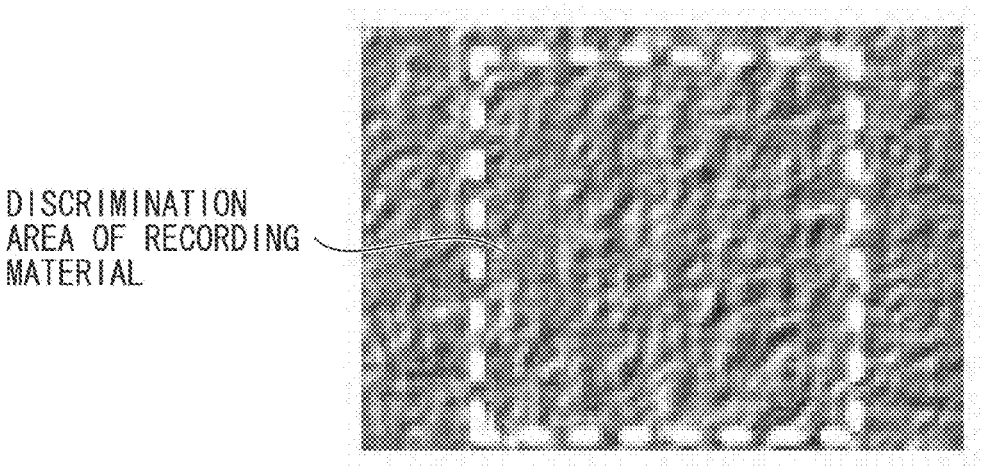

FIG. 7D illustrates the surface image of the captured recording material S subjected to the shading correction. It can be understood that the light amount nonuniformity is eliminated as compared with the surface image of FIG. 7C.

In step S104, the CPU 26 extracts the feature amount of the surface roughness of the recording material S based on the surface image of the recording material discrimination area surrounded by a white dotted line of FIG. 7D, which is subjected to the shading correction.

Examples of the feature amount include an image brightness distribution range (a contrast of the surface of the recording material) after the shading correction, and integration obtained by calculating the maximum value and the minimum value for one line when image-capturing, as peak values for each continuously acquired image and integrating the values. In the present exemplary embodiment, the image brightness distribution range is used as the feature amount.

Figure 7E:
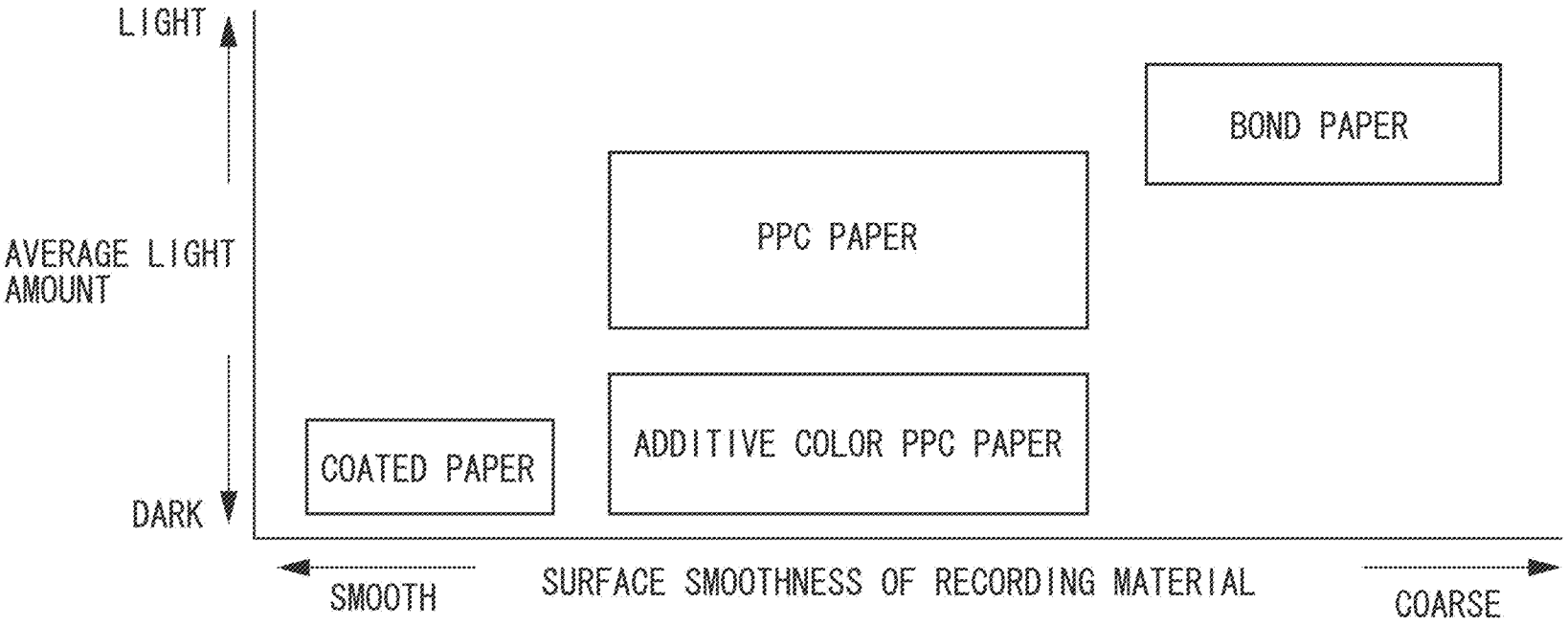
Figure 8:
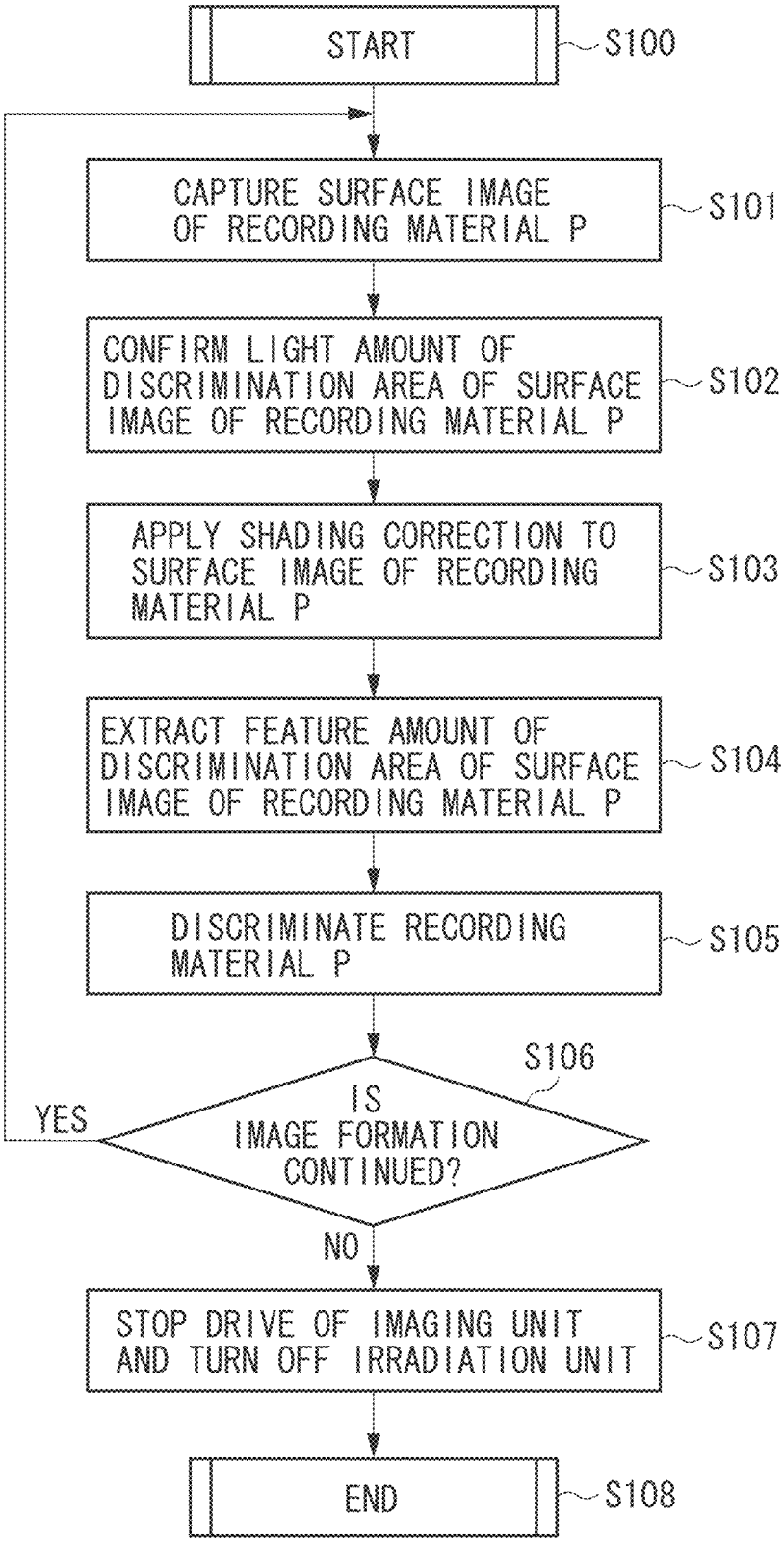
FIG. 8 is a flow chart illustrating a method for discriminating a type of a recording material S from the surface image captured by the imaging unit 49 of the recording material discrimination device 43.

In step S105, the CPU 26 discriminates the recording material S based on the whole light amount of the recording material discrimination area calculated in S102 and the feature amount in the recording material discrimination area calculated in S104. FIG. 7E illustrates an example of reference table to classify PPC paper (a recording material used in a commonly used printer and copy machine or the like), coated paper (a recording material having a surface subjected to various coatings to improve smoothness), bond paper (a recording material having rough surface properties), and additive color PPC paper (PPC paper added in color). This is used as a discrimination reference table of the recording materials.

A vertical axis represents the light amount, and a horizontal axis represents the surface roughness of the recording material S. The recording material S is discriminated by plotting intersections of the values on the graph.

In step S106, the CPU 26 determines whether or not the CPU 26 continues the image formation. When the CPU 26 continues the image formation (YES in step S106), the program returns to S101. When the CPU 26 ends the image formation (NO in step S106), the CPU 26 stops the drive of the imaging unit 49 in S107, and turns off the irradiation unit 45. In step S108, the CPU 26 stops the operation of the recording material discrimination device.

There will be described an operation for changing the speed of the image forming apparatus to a low speed mode of ½ speed without stopping the image forming apparatus when the recording material discrimination device 43 determines that the recording material S is the bond paper and the coated paper to which a low speed mode is applied, after activating the image forming apparatus at 1/1 speed.

Figure 9:
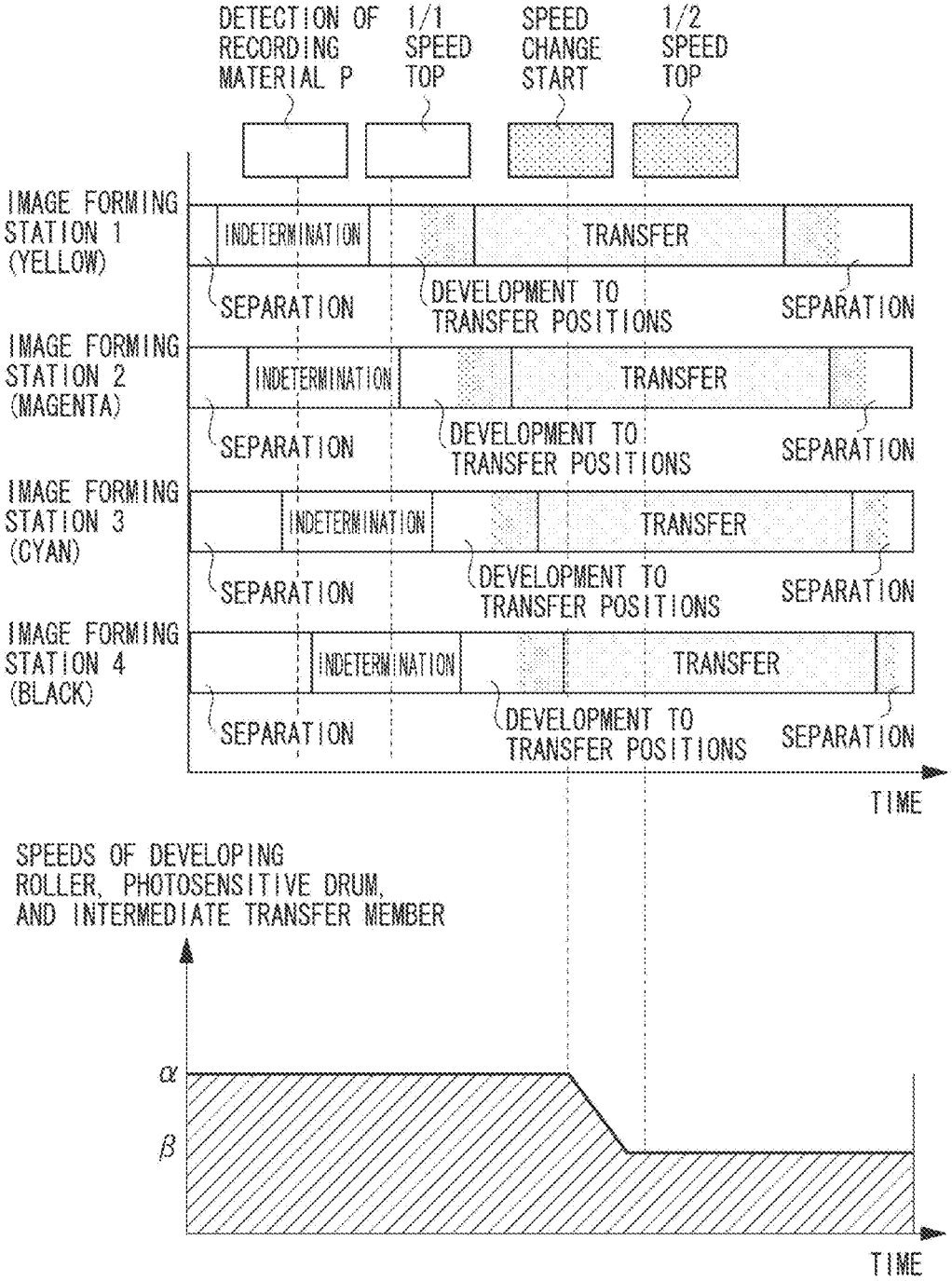
FIG. 9 illustrates an abutment state between a development roller 3 and a photosensitive drum 1 of each image forming station, a position of a toner image developed on the photosensitive drum 1, and drive speeds of the photosensitive drum 1, the development roller 3, and an intermediate transfer belt 8 as an intermediate transfer member.

FIG. 9 illustrates an abutment state between the development roller 3 and the photosensitive drum 1 of each image forming station, the position of the toner image developed on the photosensitive drum 1, and the drive speeds of the photosensitive drum 1, the development roller 3, and the intermediate transfer belt 8 as an intermediate transfer member.

Until the toner transferred onto the photosensitive drum 1 from the development roller 3 of the image forming station 4 (black) reaches a transfer position in the present exemplary embodiment, each of the other image forming stations 1 (yellow), 2 (magenta), and 3 (cyan) is continuously driven at 1/1 speed.

In the present exemplary embodiment, the transition of the toner to the photosensitive drum 1 from the development roller 3 is supposed to be generated without applying development bias unlike a development condition in ordinary image formation. Accordingly, as long as a toner amount can function as a lubricant for the photosensitive drum 1 and the intermediate transfer member unlike a toner image formed as the ordinary image formation, any other toner image may be used.

Therefore, a predetermined amount of toner can also be supplied to the photosensitive drum 1 as a toner image for a speed change by applying, for example, development bias lower than the ordinary development bias.

Then, the speeds of the development roller 3, the photosensitive drum 1, and the intermediate transfer member are simultaneously decelerated to β corresponding to ½ speed from α corresponding to 1/1 speed. In addition, α is set to a speed (180 mm/second) of 1/1 speed, and β is set to a speed (90 mm/second) of ½ speed.

The recording material S to be conveyed at an ordinary speed is detected at an execution timing without having an effect on FPOT. More specifically, the detection execution timing is set to a timing sufficient to notify a discrimination result when performing image formation at 1/1 speed, with respect to a writing timing of the image represented by 1/1 speed Top in FIG. 9, after the recording material S reaches the recording material discrimination device 43.

If the notification of the discrimination result is in time, the detection timing of the recording material S may be before and after the abutment timing of the development roller 3 of each color, or during the abutment timing. When the deceleration to ½ speed is completed, the image formation is started at ½ speed in the image forming station 1 (yellow).

Conventionally, immediately after execution of the discrimination of the recording material S, when the speeds of the photosensitive drum 1 and the intermediate transfer member are changed while the photosensitive drum 1 and the intermediate transfer member abut on each other, the photosensitive drum 1 or the intermediate transfer member may be abraded by a circumferential speed difference.

Since the present exemplary embodiment starts a speed change after all the image forming stations are in a state where toner is interposed between the photosensitive drum 1 and the intermediate transfer member, the present exemplary embodiment can reduce the possibility of the abrasion of the photosensitive drum 1 and the intermediate transfer member due to the lubricating effect of the toner.

Figure 10:
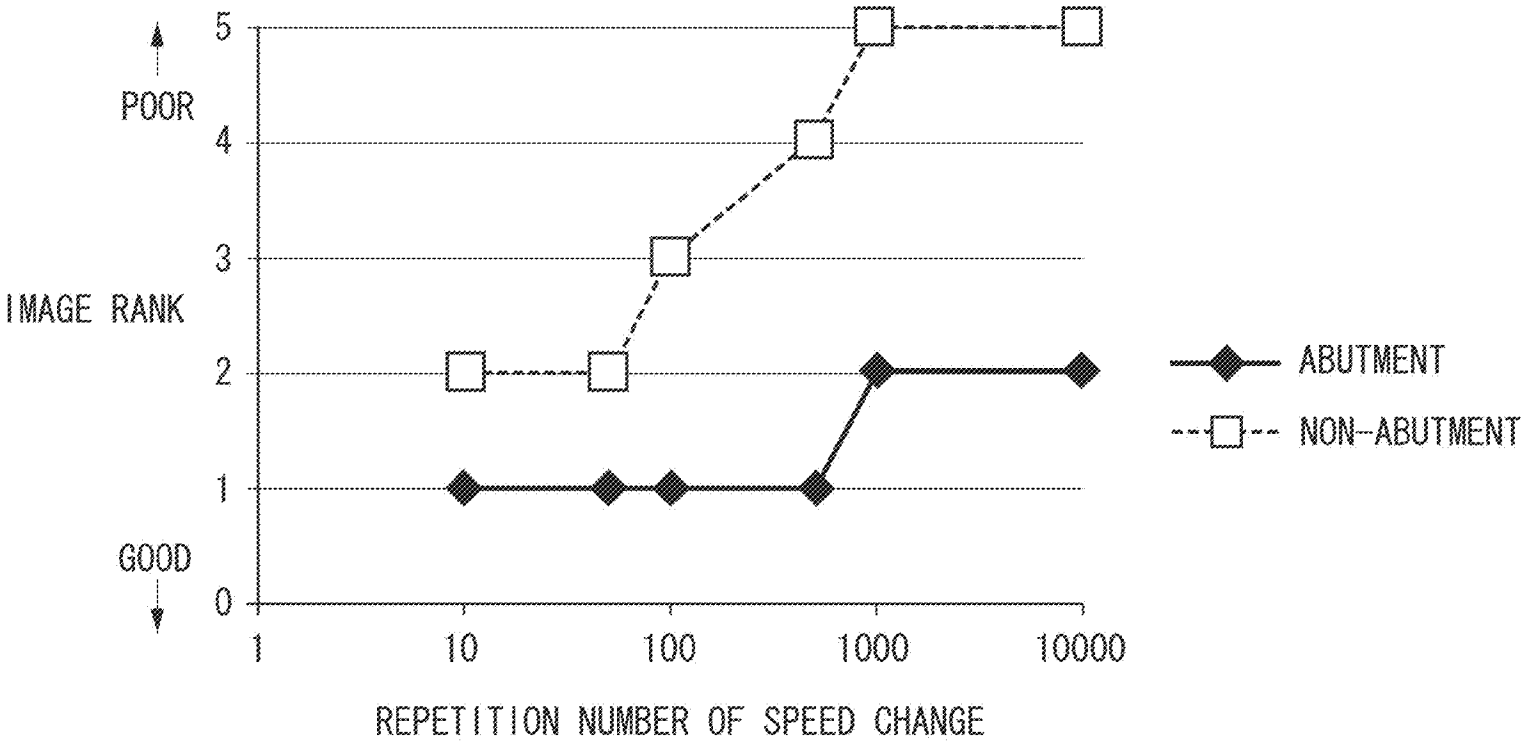
FIG. 10 is a graph illustrating a situation when performing a speed change in a state where the development roller 3 and the photosensitive drum 1 abut on each other or in a state where the development roller 3 and the photosensitive drum 1 do not abut on each other.

FIG. 10 is a graph illustrating a situation when performing a speed change in a state where the development roller 3 and the photosensitive drum 1 abut on each other or in a state where the development roller 3 and the photosensitive drum 1 do not abut on each other. A horizontal axis represents the repetition number of the speed change, and a vertical axis represents an image rank. Herein, the image rank represents the image quality of the image to be formed. When the numerical value of the image rank is increased, the image cannot be accurately formed.

The rank 1 represents a state where a normal image can be formed. The rank 3 represents a state where an image subjectively evaluated and formed by the present inventor can be determined to have no problem. The rank 4 or more represents a state where the formed image cannot be determined to have no problem. A dashed line in FIG. 10 illustrates a result obtained by repeating the speed change of the development roller 3 and the photosensitive drum 1 in a non-abutment state.

The image rank represents a state of exceeding 3 after the repetition of the speed change of about 100 times, and represents a state where the formed image cannot be determined to have no problem. On the other hand, a solid line in FIG. 10 illustrates a result obtained by repeating the speed change in a state where toner is interposed between the photosensitive drum 1 and the intermediate transfer member in a state where the development roller 3 and the photosensitive drum 1 abut on each other in the constitution of the present exemplary embodiment.

Even if the speed change is repeated about 10000 times, the image rank is 2, and the formed image can be determined to have no problem. Therefore, it can be understood that the deterioration caused by the abrasion of the photosensitive drum 1 or the intermediate transfer member can be reduced even if the speed change is generated in all the image formations when the life of the photosensitive drum 1 is equivalent to 10000 sheets.

Figure 11:
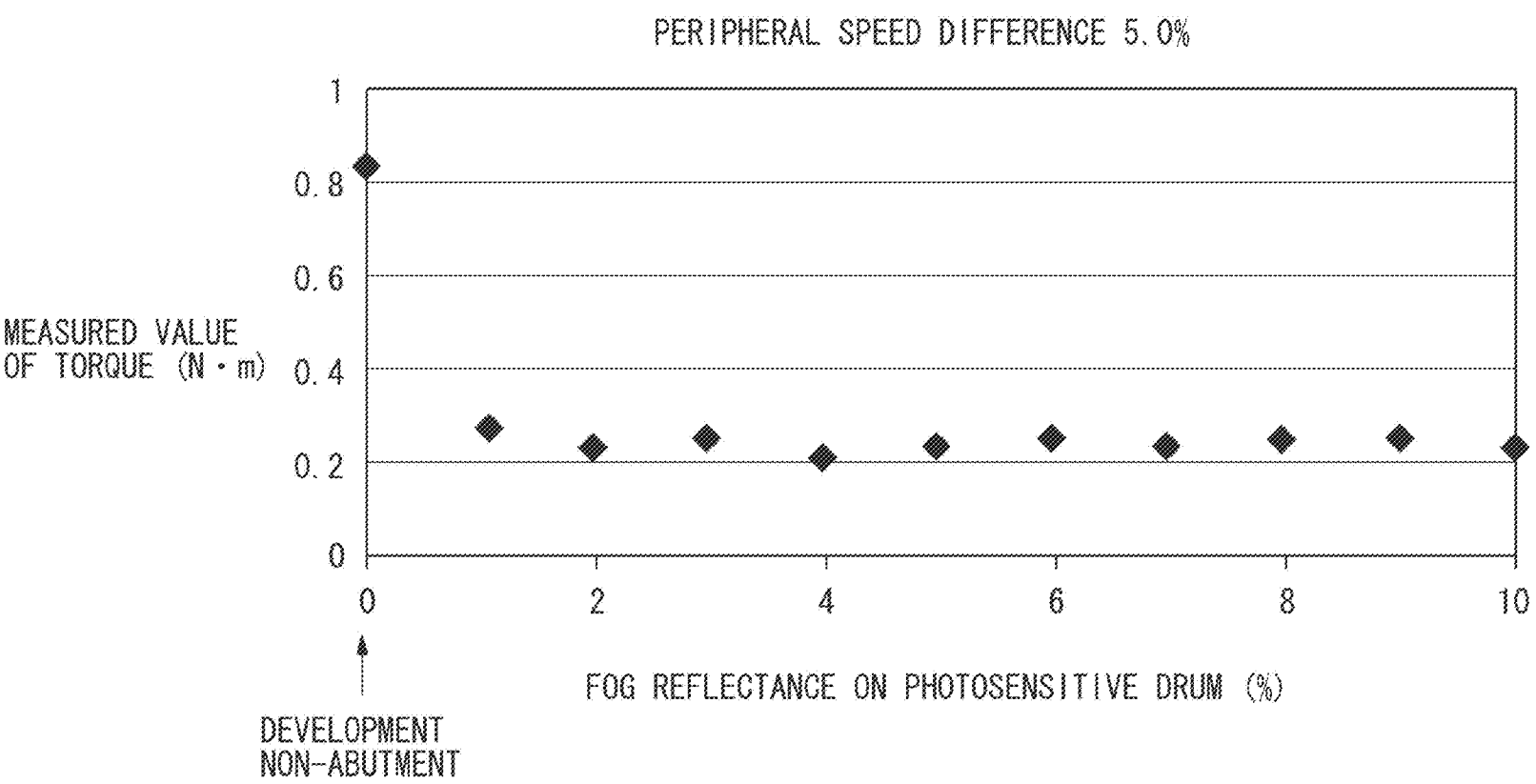
FIG. 11 is a graph illustrating a drive torque of the intermediate transfer member when a circumferential speed difference is present between the intermediate transfer member and the photosensitive drum.

FIG. 11 illustrates a drive torque of the intermediate transfer member when the circumferential speed difference is generated between the intermediate transfer member and the photosensitive drum. A horizontal axis is a numerical value obtained by measuring an amount of fog toner on the photosensitive drum 1. The fog toner means toner developed on the photosensitive drum 1 by causing the development roller 3 to abut on the photosensitive drum 1.

Since the amount of the fog toner is very small, and it is difficult to measure the weight thereof, the amount of the fog toner is defined by a reflectance. Specifically, the toner on the photosensitive drum 1 is collected by a transparent adhesive tape such as a commercially available cellophane tape manufactured by Nichiban Co. Ltd., a polyester tape manufactured by Nitto Denko Corporation, or a mending tape manufactured by Sumitomo 3M Ltd. The tape is stuck on white paper such as copy paper, and a difference between measured reflectance values of a part with toner and a part without toner is defined as a fog reflectance (%).

As a measurement device of a reflected light amount, DENSITOMETER TC-6DS (manufactured by Tokyo Denshoku Technical Center) is used. A vertical axis represents a drive torque measured on a drive shaft of the intermediate transfer member.

In the image forming apparatus according to the present exemplary embodiment, the drive torque in ordinary use is about 0.2 to 0.4 N·m. When the torque exceeds 0.6 N·m, a load on a gear train is increased. When the image formation is performed in this state, abnormal noise may be generated, or a gear may be abraded to cause the drive torque not to be applied.

FIG. 11 illustrates a state where the surface speed of the intermediate transfer member is faster by 5.0% than that of the photosensitive drum 1. This state is defined as a circumferential speed difference 5.0%. The state where the fog reflectance on the photosensitive drum 1 is 0% is a state where the development roller 3 does not abuts on the photosensitive drum 1 and the fog toner does not adhere to the photosensitive drum 1.

When the circumferential speed difference is 5.0% in this state, the drive torque of the intermediate transfer member is a high numerical value of 0.8 N·m or more. On the other hand, when the development roller 3 abuts on the photosensitive drum 1 and the fog toner adheres to the photosensitive drum 1, the drive torque of the intermediate transfer member can be lowered to about 0.3 N·m even if the fog reflectance is an extremely small amount of about 1%.

The fog reflectance on the photosensitive drum 1 is not 1% or less even if the toner and each of members such as the development roller 3 and the photosensitive drum 1 are in mint condition. Thereby, if the toner is provided between the photosensitive drum 1 and the intermediate transfer member, the drive torque can be sufficiently reduced and stabilized.

Even when the amount of the fog toner on the photosensitive drum 1 is increased to 1% or more, the drive torque can be similarly reduced. If the toner is provided between the photosensitive drum 1 and the intermediate transfer member, the drive torque can be sufficiently reduced and stabilized.

Thus, as can be understood from FIG. 11, when the toner is provided between the photosensitive drum 1 and the intermediate transfer member even if the speed difference between the photosensitive drum 1 and the intermediate transfer member is increased such as the speed change to ½ speed from 1/1 speed, the drive torque of the intermediate transfer member can be suppressed and stabilized. Therefore, the generation of the deterioration caused by the abrasion of the photosensitive drum 1 or the intermediate transfer member can be reduced.

Figure 12A:
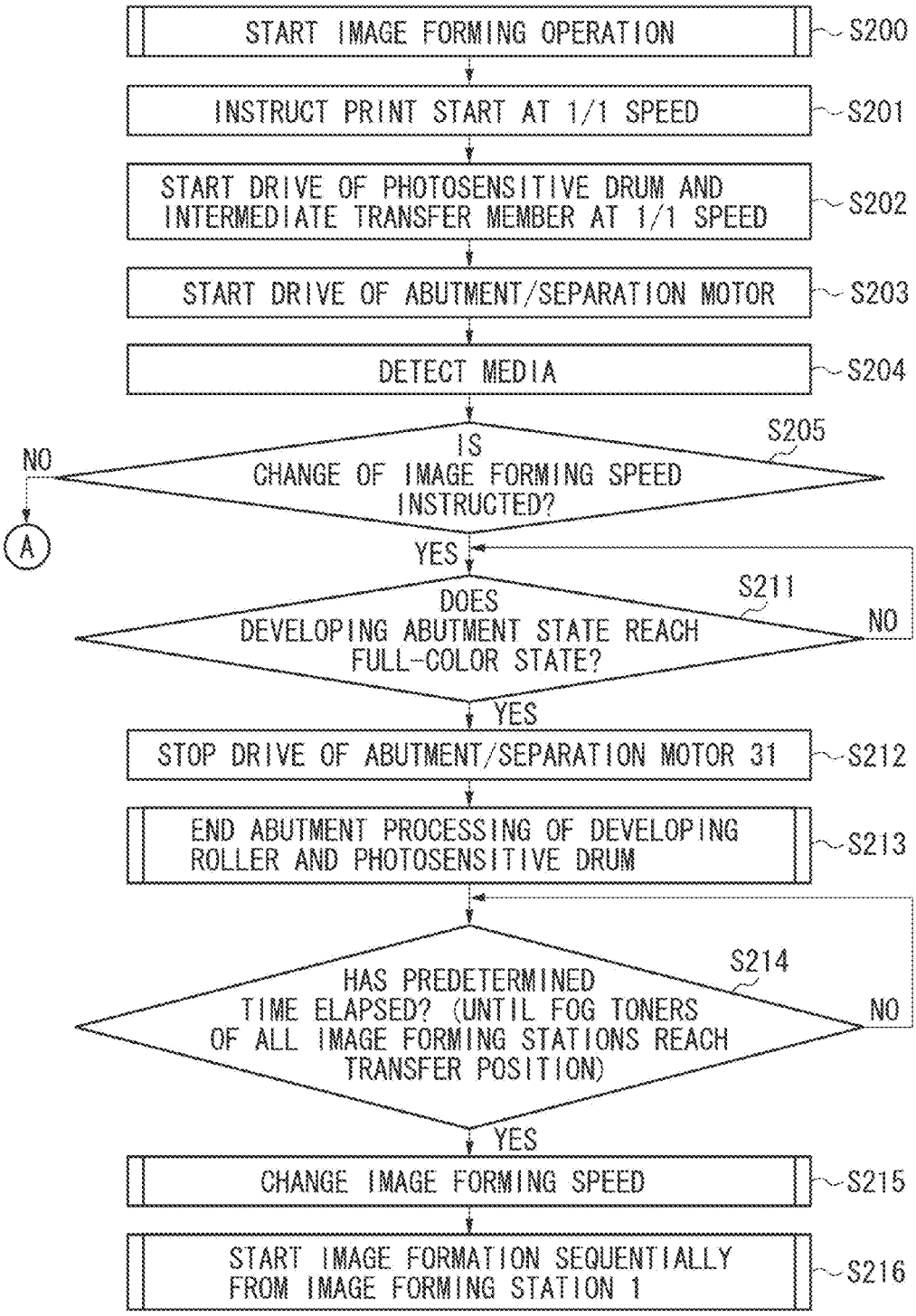
FIG. 12 (12A+12B) is a flow chart illustrating a method for performing control so as to change an image forming speed.
Figure 12B:
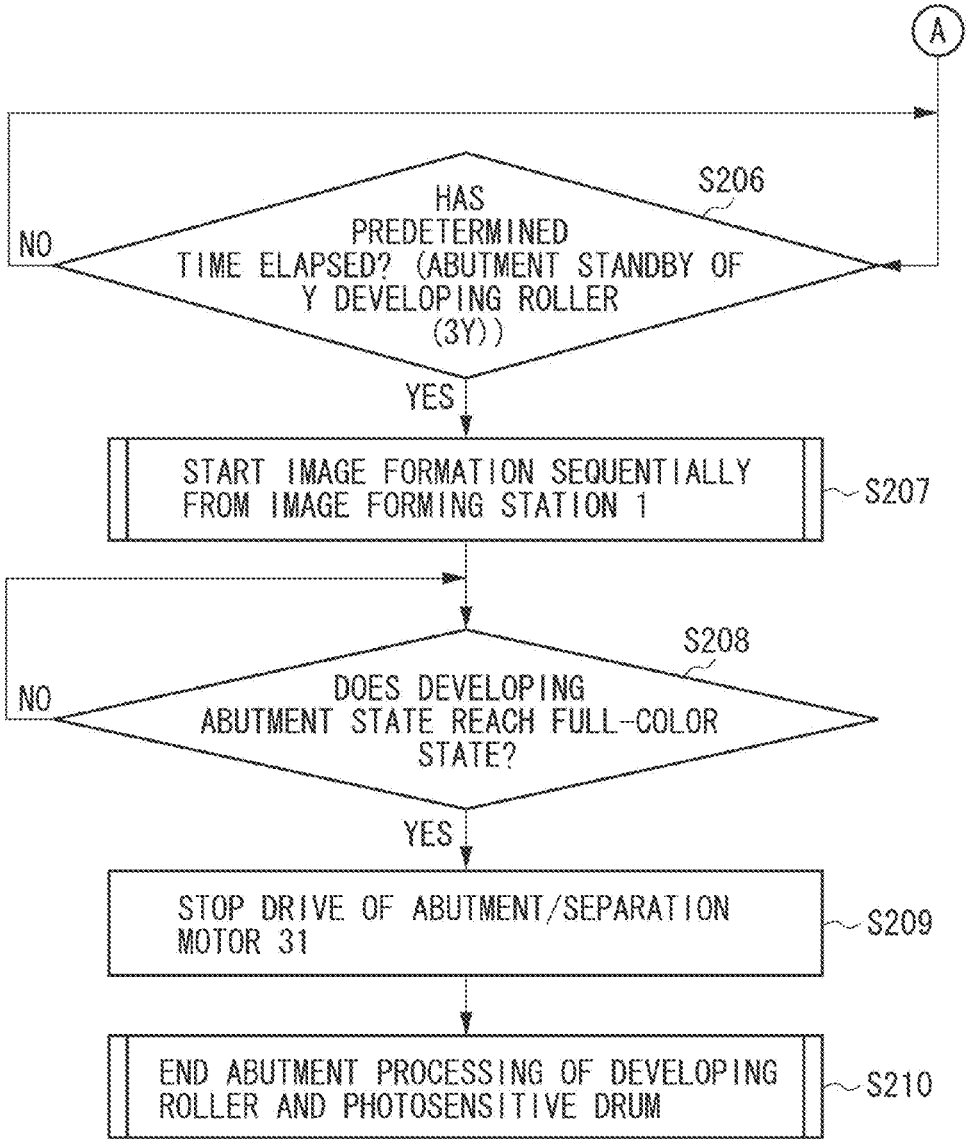

A method for performing image forming speed change control will be described with reference to a flow chart of FIG. 12 (12A+12B). Herein, the method will be described using 1/1 speed and ½ speed as an example of the image forming speed. However, the image forming speed is not limited thereto.

In step S201, if the CPU 26 receives an image formation command at 1/1 speed, the CPU 26 starts the image formation at 1/1 speed. In step S202, the CPU 26 starts the drive of the photosensitive drum 1 and the intermediate transfer member at 1/1 speed. In step S203, the CPU 26 starts the drive of the abutment/separation motor. In step S204, the CPU 26 starts the discrimination of the recording material S according to the recording material discrimination device 43.

In step S205, the CPU 26 determines whether or not the image forming speed is changed based on the discrimination result of the recording material S. When the image forming speed is not changed (NO in step S205), in step S206, the CPU 26 determines whether or not the development roller 3Y abuts on the photosensitive drum 1Y. Since the CPU 26 can start the image formation of the Y station when the development roller 3Y abuts on the photosensitive drum 1Y (YES in step S206), the CPU 26 sequentially starts the image formation in the image forming station 1 (Y) in step S207.

In step S208, the CPU 26 determines whether or not the development rollers of all the colors abut on the photosensitive drums to be brought into a full-color abutment state. When all the development rollers abut on the photosensitive drum, the CPU stops the drive of the abutment/separation motor 31 in step S209. In step S210, the CPU 26 ends the abutment processing of the development roller and the photosensitive drum.

On the other hand, in step S205, when the image forming speed is changed according to the discrimination result of the recording material S (YES in step S205), the processing proceeds to S211. The present exemplary embodiment will be described based on the case where the image forming speed is changed to ½ speed. However, the image forming speed can also be set to a speed other than ½ speed.

In step S211, the CPU 26 drives the abutment/separation motor 31 until the development roller abuts on the photosensitive drum to be brought into a full-color abutment state. In the abutment/separation state, the CPU 26 stops the drive of the abutment/separation motor 31 in step S212. In step S213, the CPU 26 ends the abutment processing of the development roller and the photosensitive drum.

After the CPU 26 ends the abutment processing in step S214, the CPU 26 stands by for a predetermined time until the toners of all the image forming stations are conveyed to the transfer position. After the predetermined time lapses and when the toners of all the image forming stations is conveyed to the transfer position, in step S215, the CPU 26 changes the image forming speed to ½ speed from 1/1 speed.

The toner used herein is cleaned by a cleaning blade. If the CPU 26 completes the change of the image forming speed, the CPU 26 sequentially starts the image formation in the image forming station 1 (Y) in step S216.

An image forming apparatus in which a time taken until the recording material S is discharged after the image formation is completed at ordinary 1/1 speed is 10 seconds performs the conventional control and the control of the present exemplary embodiment experimentally.

As the conventional way, after the image forming apparatus is activated at the image forming speed of 1/1 speed, the speed change is performed according to the discrimination result of the type of the recording material S. In this case, when control is performed so as to activate the image forming apparatus at the image forming speed of ½ speed again after a post-rotation is performed, a time until the recording material S is discharged after the image formation is completed is 25 seconds.

On the other hand, in the control of the present exemplary embodiment, the speed change is performed according to the discrimination result of the type of the recording material S after the image forming apparatus is activated at the image forming speed of 1/1 speed. In this case, after the toner is conveyed to the transfer position without performing a post-rotation, the image forming speed is changed to ½ speed. Therefore, a time taken until the recording material S is discharged after the image formation is completed is 13 seconds.

With the result, it can be understood that the time required for changing the image forming speed in the control of the present exemplary embodiment can be shortened as compared with that in the conventional control.

Thus, when the image forming speed is changed, control is performed so as to change the speeds of the photosensitive drum and the intermediate transfer member in the state where the toner is provided between the photosensitive drum and the intermediate transfer member. Thereby, when the image forming speed is changed, the deterioration caused by the abrasion of the photosensitive drum and the intermediate transfer member can be reduced, and the time required for changing the image forming speed can be suppressed.

The first exemplary embodiment has been described using the contact type development method. A second exemplary embodiment will be described using a jumping development method, which is a non-contact type development method.

Figure 13:
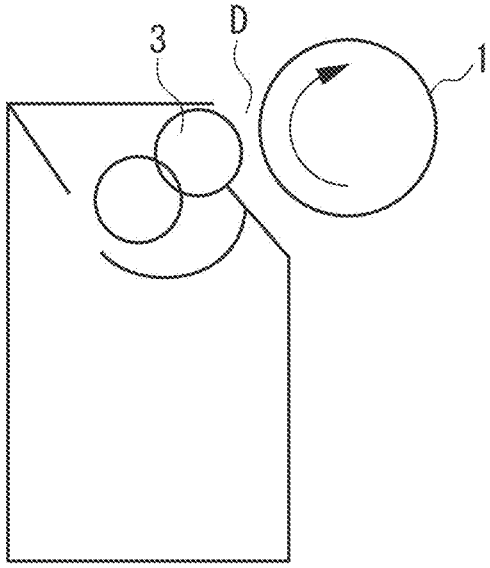
FIG. 13 illustrates a development device employing a jumping development method.

The jumping development method develops toner using an AC bias voltage obtained by superposing DC bias applied between a development roller 3 and a photosensitive drum 1 in a development area which is a part closest to the development roller 3 and the photosensitive drum 1 in a state where the development roller 3 and the photosensitive drum 1 are in non-contact state. FIG. 13 illustrates an example of a development device using the jumping development method.

The development device of the jumping development method has a gap D (hereinbelow, also referred to as "an SD gap") between the development roller 3 and the photosensitive drum 1 at a development position. The SD gap is preferably set to 100 to 500 μm by a photosensitive drum abutting roller rotatably supported by a development roller shaft, and more preferably set to 300 μm or less.

When the SD gap is less than 100 μm, an electric field is apt to be leaked to the photosensitive drum 1 from the development roller 3, which makes it difficult to develop a latent image. On the other hand, when the SD gap is 500 μm or more, the toner tends to hardly fly to the photosensitive drum 1.

The present exemplary embodiment performs jumping development with the SD gap set to 250 μm, and DC and AC superimposed voltages applied to the development roller 3.

An alternating electric field at that time is applied with a peak-to-peak voltage set to 1900 V and a frequency set to 3000 Hz. An aluminum tube having resin coating thereon is used as the development roller 3. The aluminum tube has a ten-point average surface roughness Rz of 8.3 μm and a center line surface roughness Ra of 0.8 μm.

Figure 14:
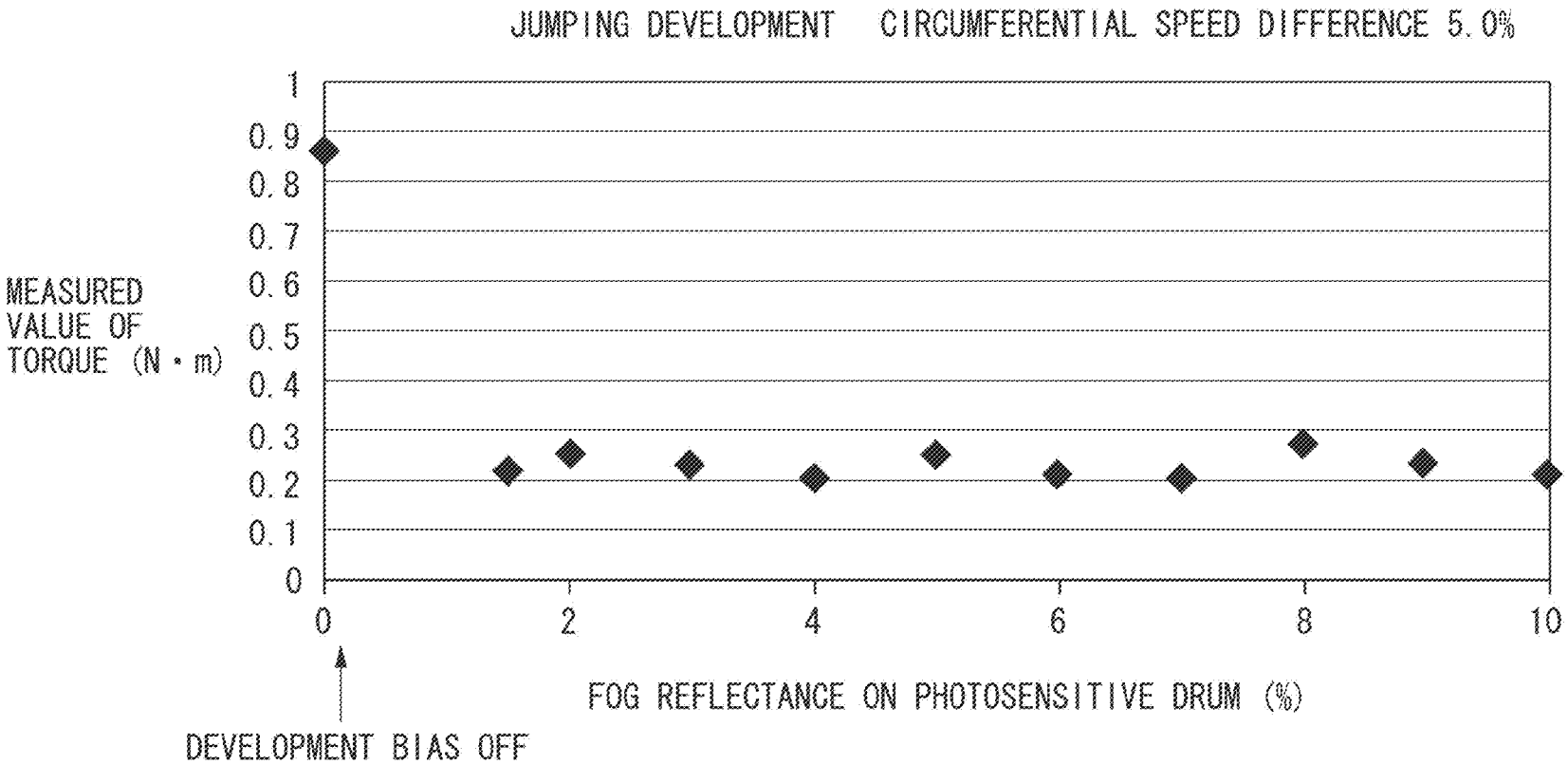
FIG. 14 is a graph illustrating a drive torque of the intermediate transfer member in a state where development bias is applied and in a state where the development bias is not applied.

FIG. 14 illustrates a state where the surface speed of the intermediate transfer member is faster by 5.0% than that of the photosensitive drum 1 in a state where development bias is applied and in a state where the development bias is not applied. This state is defined as a circumferential speed difference 5.0%.

In the circumferential speed difference 0% which is a state where fog toner is not developed on the photosensitive drum without applying the development bias, the drive torque of the intermediate transfer member is a high numerical value of 0.8 N·m or more as in the first exemplary embodiment.

On the other hand, it can be understood that the drive torque of the intermediate transfer member can be lowered to about 0.2 to 0.3 N·m in a state where the development bias is applied. Therefore, it can be understood that the drive torque can be sufficiently reduced and stabilized if the fog toner is provided between the photosensitive drum 1 and the intermediate transfer member also in the jumping development method as in the contact development method.

Thus, an image forming speed is changed in a state where the fog toner is provided between the intermediate transfer member and the photosensitive drum as in the first exemplary embodiment also in an image forming apparatus using the jumping development method. Thereby, generation of deterioration caused by abrasion of the photosensitive drum and the intermediate transfer member can be reduced, and a time required for changing the image forming speed can be suppressed.

In the first exemplary embodiment and the second exemplary embodiment, the method for using the cleaning blade as the cleaning unit of the intermediate transfer member has been described. In a third exemplary embodiment, a method for using a cleaning roller as the cleaning unit of the intermediate transfer member will be described.

Figure 15:
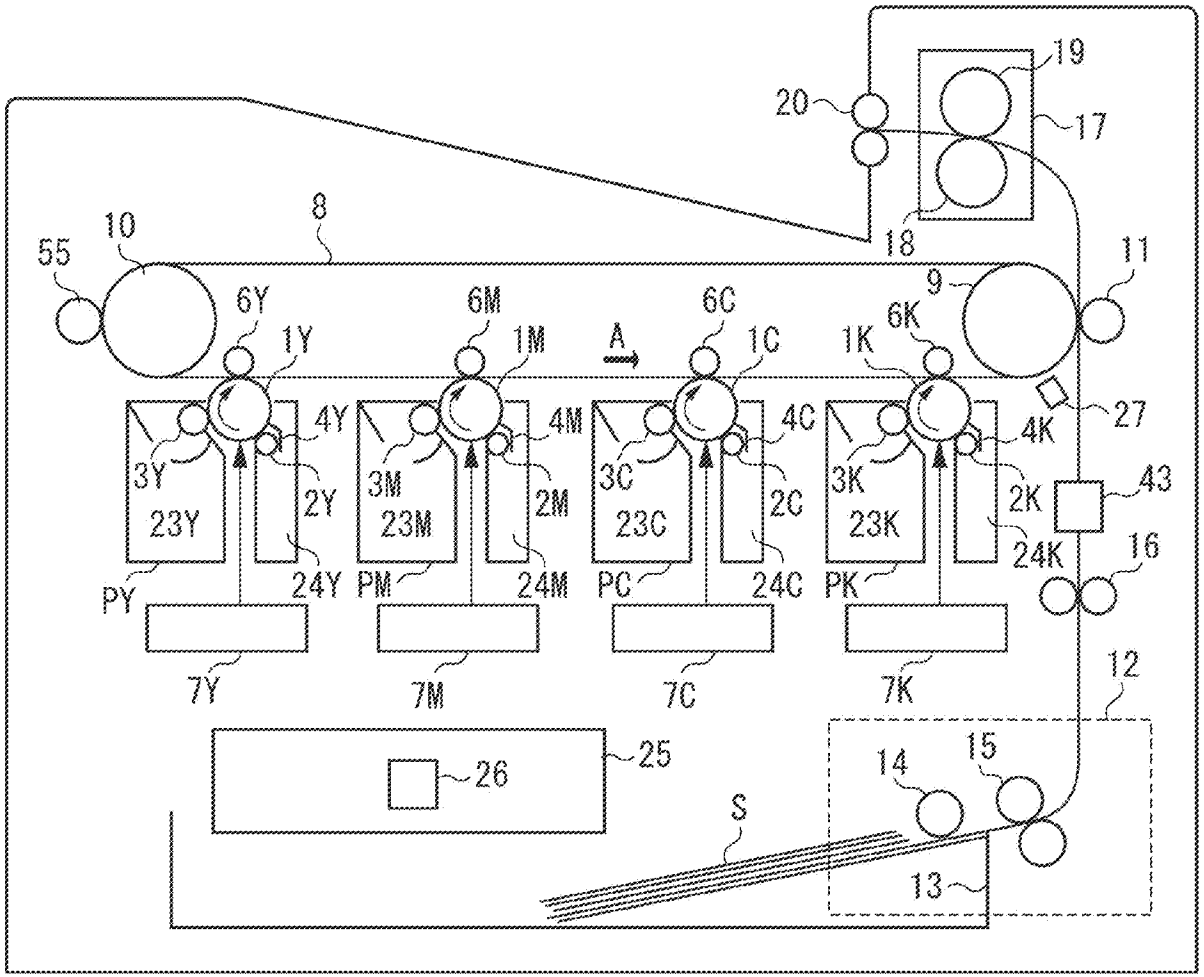
FIG. 15 is a schematic constitution diagram of an image forming apparatus in a third exemplary embodiment.

FIG. 15 is a schematic configuration diagram of an image forming apparatus according to the present exemplary embodiment. Since the difference between FIG. 15 and FIG. 1 is only a cleaning roller 55, the descriptions of components other than the cleaning roller 55 will be omitted.

The cleaning roller 55 charges residual toner remaining on the intermediate transfer member to polarity reverse to polarity charged by a development roller 3. Thus, the residual toner is charged to the reverse polarity, and thereby the residual toner can be reversely transferred to a photosensitive drum 1 from the intermediate transfer member in a primary transfer portion configured to ordinarily transfer toner to the intermediate transfer member from the photosensitive drum 1 by a transfer roller.

Thus, the intermediate transfer member is cleaned by reversely transferring the residual toner on the intermediate transfer member to the photosensitive drum 1.

The cleaning roller 55 is a solid rubber roller having a resistance adjusted to 10E5 to 10E9 ohms. A voltage of 0.3 to +1.0 kV is applied to the cleaning roller 55 from a high-voltage power supply (not illustrated).

The toner in forming an image is charged to negative polarity, and the toner is electrostatically transferred by applying positive bias to a primary transfer roller 6 and a secondary transfer roller 11.

Consequently, the residual toner remaining on the intermediate transfer member without being transferred to a recording material by secondary transfer is mostly kept charged to negative polarity. Therefore, the residual toner on the intermediate transfer member is charged to an appropriate charge amount having positive polarity by the cleaning roller 55. Then, the residual toner is reversely transferred in the primary transfer portion of the photosensitive drum 1.

Figure 16:
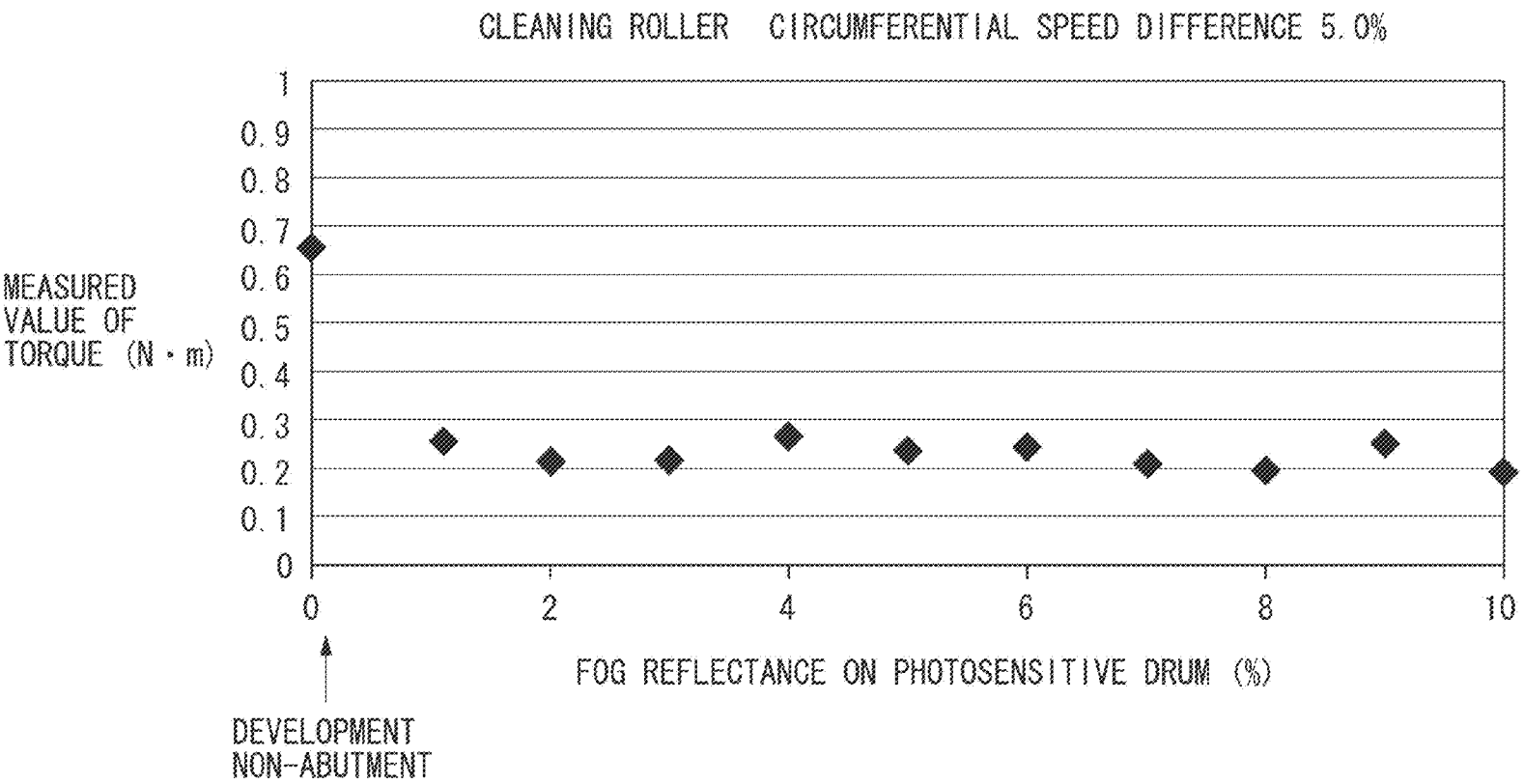
FIG. 16 is a graph illustrating a drive torque of the intermediate transfer member when using a cleaning roller.

The present exemplary embodiment conveys the residual toner on the intermediate transfer member between the photosensitive drum 1 and the intermediate transfer member, and performs control so as to change a speed in a state where the residual toner is provided. FIG. 16 illustrates a result obtained by investigating a torque reduction effect when a circumferential speed difference is applied between the intermediate transfer member and the photosensitive drum 1 by the residual toner on the intermediate transfer member.

FIG. 16 illustrates a state where the surface speed of the intermediate transfer member is faster by 5.0% than that of the photosensitive drum 1. This state is defined as a circumferential speed difference 5.0%.

In a state where a fog reflectance on the photosensitive drum 1 is 0%, the drive torque of the intermediate transfer member is about 0.65 N·m. This generates the torque reduction effect of about 0.2 N·m by using the cleaning roller, as compared with about 0.85 N·m in the first exemplary embodiment using the cleaning blade.

However, when the intermediate transfer member is driven with the drive torque of about 0.65 N·m, the intermediate transfer member and the photosensitive drum are abraded.

On the other hand, when the development roller 3 abuts on the photosensitive drum 1, and fog toner adheres to the photosensitive drum 1 also in the present exemplary embodiment, the drive torque of the intermediate transfer member can be lowered to about 0.3 N·m.

Thereby, if the fog toner is provided between the photosensitive drum 1 and the intermediate transfer member, the drive torque can be sufficiently reduced and stabilized.

Thus, an image forming speed is changed in a state where the fog toner is provided between the intermediate transfer member and the photosensitive drum also in the image forming apparatus using the cleaning roller as in the first exemplary embodiment. Thereby, the generation of the deterioration caused by the abrasion of the photosensitive drum and the intermediate transfer member can be reduced, and a time required for changing the image forming speed can be suppressed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-150905 filed Jul. 7, 2011, which is hereby incorporated by reference herein in its entirety.

What is claimed is:

1. An image forming apparatus comprising:

a photosensitive member on which a latent image is formed;

a development unit configured to develop the latent image formed on the photosensitive member as a toner image;

a rotating member on which the toner image formed on the photosensitive member is transferred, wherein the toner image is transferred on the rotating member at a nip portion where the rotating member contacts the photosensitive member; and a control unit configured to control speeds of the photosensitive member and the rotating member, wherein the control unit changes the speeds of the photosensitive member and the rotating member in a state where toner exists at the nip portion, and wherein, for changing the control speed from a first speed to a second speed, the control unit makes a toner to exist on the nip portion by providing the toner from the developing unit to the photosensitive member.

2. The image forming apparatus according to claim 1, further comprising a recording material discrimination unit configured to discriminate a type of a recording material, wherein the control unit is configured to change the speed of the photosensitive member and the rotating member according to information produced by the recording material discrimination unit.

3. The image forming apparatus according to claim 1, wherein the development unit is configured to develop the latent image by contacting the photosensitive member.

4. The image forming apparatus according to claim 2, wherein the development unit is configured to develop the latent image by contacting the photosensitive member.

5. The image forming apparatus according to claim 1, wherein the development unit is configured to develop the latent image without contacting the photosensitive member.

6. The image forming apparatus according to claim 2, wherein the development unit is configured to develop the latent image without contacting the photosensitive member.

7. The image forming apparatus according to claim 1, further comprising a cleaning unit configured to clean the toner image formed on the rotating member, wherein the cleaning unit is a cleaning blade.

8. The image forming apparatus according to claim 1, further comprising a cleaning unit configured to clean the toner image formed on the rotating member, wherein the cleaning unit is a cleaning roller.

9. The image forming apparatus according to claim 1, wherein the toner supplied to the nip portion when changing the speed of the photosensitive member and the rotating member is the toner moved to the photosensitive member from the development unit without the latent image being formed on the photosensitive member.

10. The image forming apparatus according to claim 2, wherein the toner supplied to the nip portion when changing the speed of the photosensitive member and the rotating member is the toner moved to the photosensitive member from the development unit without the latent image being formed on the photosensitive member.

11. The image forming apparatus according to claim 3, wherein the toner supplied to the nip portion when changing the speed of the photosensitive member and the rotating member is the toner moved to the photosensitive member from the development unit without the latent image being formed on the photosensitive member.

12. The image forming apparatus according to claim 4, wherein the toner supplied to the nip portion when changing the speed of the photosensitive member and the rotating member is the toner moved to the photosensitive member from the development unit without the latent image being formed on the photosensitive member.

13. The image forming apparatus according to claim 5, wherein the toner supplied to the nip portion when changing the speed of the photosensitive member and the rotating member is the toner moved to the photosensitive member from the development unit without the latent image being formed on the photosensitive member.

14. The image forming apparatus according to claim 6, wherein the toner supplied to the nip portion when changing the speed of the photosensitive member and the rotating member is the toner moved to the photosensitive member from the development unit without the latent image being formed on the photosensitive member.

15. The image forming apparatus according to claim 1, wherein the rotating member is an intermediate transfer member.

16. The image forming apparatus according to claim 1, wherein the control unit performs control to drive the photosensitive member and the rotating member at a first speed so that the nip portion is supplied with the toner and to drive, in a state where the toner exists at the nip portion, the photosensitive member and the rotating member at a second speed different from the first speed.

17. The image forming apparatus according to claim 16, wherein the first speed and the second speed are image forming speeds.

18. The image forming apparatus according to claim 1, wherein the control unit changes the control speed from the first speed to the second speed without stopping the photosensitive member and the rotating member.

19. The image forming apparatus according to claim 1, wherein a toner provided to the nip portion is different from a toner that is transferred from the rotating member to a recording material.

* * * * *